US011335255B2

(12) United States Patent
Park

(10) Patent No.: US 11,335,255 B2
(45) Date of Patent: May 17, 2022

(54) SIGNAL PROCESSING DEVICE AND IMAGE DISPLAY APPARATUS INCLUDING THE SAME

(71) Applicant: LG ELECTRONICS INC., Seoul (KR)

(72) Inventor: Sungjin Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/016,038

(22) Filed: Sep. 9, 2020

(65) Prior Publication Data

US 2021/0074209 A1 Mar. 11, 2021

(30) Foreign Application Priority Data

Sep. 9, 2019 (KR) ..... 10-2019-0111643

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2310/027* (2013.01); *G09G 2320/0233* (2013.01)

(58) Field of Classification Search
None
See application file for complete search history.

(56) References Cited

U.S. PATENT DOCUMENTS

2013/0342585 A1* 12/2013 Chun ..... G09G 3/3208 345/690
2018/0330695 A1* 11/2018 Baar ..... G06K 9/6202
2019/0191150 A1* 6/2019 Zhang ..... G09G 3/006

FOREIGN PATENT DOCUMENTS

| | | |
|---|---|---|
| JP | 2009017306 | 1/2009 |
| KR | 101183399 | 9/2012 |
| KR | 1020180005862 | 1/2018 |
| KR | 1020180052246 | 5/2018 |

OTHER PUBLICATIONS

PCT International Application No. PCT/KR2020/012134, International Search Report dated Dec. 23, 2020, 3 pages.

* cited by examiner

*Primary Examiner* — Christopher J Kohlman
(74) *Attorney, Agent, or Firm* — Lee Hong Degerman Kang & Waimey

(57) ABSTRACT

A signal processing device and an image display apparatus including the same are disclosed. The image display apparatus includes a display including an organic light emitting diode panel and a signal processor configured to control the display, wherein the signal processor is configured to perform luminance conversion based on a first luminance conversion pattern in the case in which the luminance level of an input image is greater a first level and to perform luminance conversion based on a second luminance conversion pattern having a higher luminance level than the first luminance conversion pattern in the case in which the luminance level of the input image is equal to or less than the first level, whereby low gray level expression of the organic light emitting diode panel is improved.

17 Claims, 23 Drawing Sheets

(a)

(b)

SIGNAL PROCESSING DEVICE AND IMAGE DISPLAY APPARATUS INCLUDING THE SAME

CROSS-REFERENCE TO RELATED APPLICATION

Pursuant to 35 U.S.C. § 119(a), this application claims the benefit of earlier filing date and right of priority to Korean Patent Application No. 10-2019-0111643, filed on Sep. 9, 2019, the contents of which are all hereby incorporated by reference herein in their entirety.

BACKGROUND OF THE INVENTION

1. Field of the Invention

The present disclosure relates to a signal processing device and an image display apparatus including the same, and more particularly to a signal processing device capable of improving low gray level expression of an organic light emitting diode panel and an image display apparatus including the same.

2. Description of the Related Art

A signal processing device is a device that performs signal processing on an input image so as to display an image.

For example, the signal processing device may receive various image signals, such as a broadcast signal or an HDMI signal, may perform signal processing based on the received broadcast or HDMI signal, and may output a processed image signal to a display.

Meanwhile, in the case in which the display is an organic light emitting diode panel, a luminance difference rate with respect to an adjacent pixel is remarkably great at the time of low gray level, compared to a liquid crystal panel.

As a result, in the case in which the gray level of an input image is low in the state in which the display is an organic light emitting diode panel, it is difficult to visually distinguish between dark portions.

SUMMARY OF THE INVENTION

An object of the present disclosure is to provide a signal processing device capable of improving low gray level expression of an organic light emitting diode panel and an image display apparatus including the same.

Another object of the present disclosure is to provide a signal processing device capable of improving low gray level expression of an organic light emitting diode panel based on ambient illuminance and an image display apparatus including the same.

In accordance with an aspect of the present disclosure, the above and other objects can be accomplished by the provision of an image display apparatus including a display including an organic light emitting diode panel and a signal processor configured to control the display, wherein the signal processor is configured to perform luminance conversion based on a first luminance conversion pattern in the case in which the luminance level of an input image is greater a first level and to perform luminance conversion based on a second luminance conversion pattern having a higher luminance level than the first luminance conversion pattern in the case in which the luminance level of the input image is equal to or less than the first level.

Meanwhile, an image display apparatus according to an embodiment of the present disclosure may further include an illuminance sensor configured to sense illuminance around the display, wherein the signal processor may perform control to change the first level based on illuminance sensed by the illuminance sensor.

Meanwhile, the signal processor may perform control to increase the first level as an illuminance level sensed by the illuminance sensor increases.

Meanwhile, a change rate of the second luminance conversion pattern may be greater than a change rate of the first luminance conversion pattern.

Meanwhile, in the case in which the luminance level of the input image is equal to or less than the first level, the signal processor may perform conversion to a luminance level higher than the luminance level of the input image.

Meanwhile, the signal processor may provide a luminance setting screen including a manual setting item for level setting of the first level, an automatic setting item for automatic setting of the first level, and a fixed item for fixed setting of the first level.

Meanwhile, the automatic setting item may include an illuminance-based automatic setting item for automatic setting of the first level based on ambient illuminance and a noise-based automatic setting item for automatic setting of the first level based on noise of the input image.

Meanwhile, the signal processor may include an image analyzer configured to analyze luminance of the input image and a luminance converter configured to perform luminance conversion based on the luminance analyzed by the image analyzer, and the luminance converter may be configured to perform luminance conversion based on the first luminance conversion pattern in the case in which the luminance level of the input image is greater the first level and to perform luminance conversion based on the second luminance conversion pattern having a higher luminance level than the first luminance conversion pattern in the case in which the luminance level of the input image is equal to or less than the first level.

Meanwhile, the signal processor may further include a noise reducer configured to perform noise reduction with respect to the input image, and the noise reducer may perform noise reduction in stages.

Meanwhile, the signal processor may be configured to insert a predetermined pattern into the input image and to change the luminance level of the pattern, to perform luminance conversion based on the first luminance conversion pattern in the case in which the luminance level of the pattern is greater the first level, and to perform luminance conversion based on the second luminance conversion pattern in the case in which the luminance level of the pattern is equal to or less than the first level.

Meanwhile, the signal processor may be configured to insert a predetermined pattern into the input image and to change the luminance level of the pattern, to perform uniform-rate luminance conversion in the case in which the luminance level of the pattern is greater the first level, and to perform luminance conversion for increasing luminance increment in the case in which the luminance level of the pattern is equal to or less than the first level.

In accordance with another aspect of the present disclosure, there is provided an image display apparatus including a display including an organic light emitting diode panel and a signal processor configured to control the display, wherein the signal processor is configured to insert a predetermined pattern into an input image and to change the luminance level of the pattern, to perform luminance conversion based on a first luminance conversion pattern in the case in which the luminance level of the pattern is greater a first level, and to perform luminance conversion based on a second luminance conversion pattern having a higher luminance level than the first luminance conversion pattern in the case in which the luminance level of the pattern is equal to or less than the first level.

Meanwhile, the signal processor may be configured to perform uniform-rate luminance conversion in the case in which the luminance level of the pattern is greater the first level and to perform luminance conversion based on the second luminance conversion pattern having a nonuniform rate, in the case in which the luminance level of the pattern is equal to or less than the first level.

In accordance with a further aspect of the present disclosure, there is provided a signal processing device including an image analyzer configured to analyze luminance of an input image and a luminance converter configured to perform luminance conversion based on the luminance analyzed by the image analyzer, wherein the luminance converter is configured to perform luminance conversion based on a first luminance conversion pattern in the case in which the luminance level of the input image is greater a first level and to perform luminance conversion based on a second luminance conversion pattern having a higher luminance level than the first luminance conversion pattern in the case in which the luminance level of the input image is equal to or less than the first level.

Meanwhile, a signal processing device according to an embodiment of the present disclosure may further include a noise reducer configured to perform noise reduction with respect to the input image, wherein the noise reducer may perform noise reduction in stages.

Meanwhile, the luminance converter may perform control such that the first level is changed based on illuminance around a display.

Meanwhile, the luminance converter may perform control such that a change rate of the second luminance conversion pattern is greater than a change rate of the first luminance conversion pattern.

Meanwhile, the luminance converter may be configured to insert a predetermined pattern into the input image and to change a luminance level of the pattern, to perform luminance conversion based on the first luminance conversion pattern in the case in which the luminance level of the pattern is greater a first level, and to perform luminance conversion based on the second luminance conversion pattern in the case in which the luminance level of the pattern is equal to or less than the first level.

Meanwhile, the luminance converter may be configured to perform uniform-rate luminance conversion in the case in which the luminance level of the pattern is greater the first level and to perform luminance conversion based on the second luminance conversion pattern having a nonuniform rate, in the case in which the luminance level of the pattern is equal to or less than the first level.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Hereinafter, the present disclosure will be described in detail with reference to the accompanying drawings.

Figure 1:
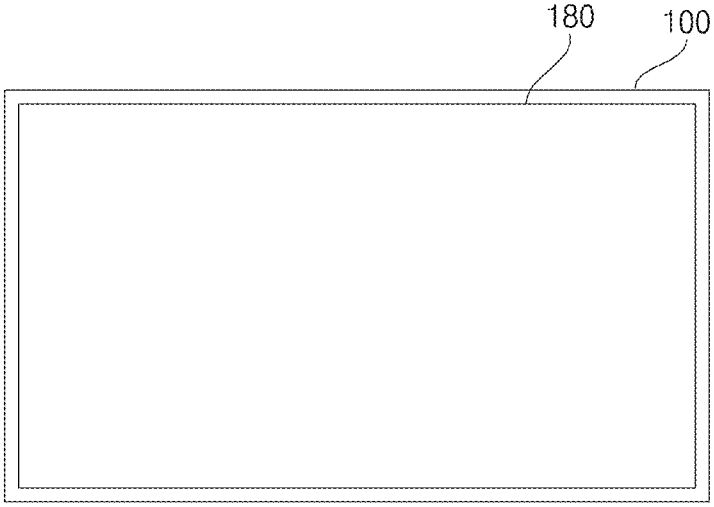
FIG. 1 is a diagram showing an image display apparatus according to an embodiment of the present disclosure.

FIG. 1 is a diagram showing an image display apparatus according to an embodiment of the present disclosure.

Referring to the figure, the image display apparatus 100 may include a display 180.

Meanwhile, the display 180 may be implemented with any one of various panels. For example, the display 180 may be any one of a liquid crystal display panel (LCD panel), an organic light emitting diode panel (OLED panel), and an inorganic light emitting diode panel (LED panel).

In the present disclosure, an example in which the display 180 includes the organic light emitting diode panel (OLED panel) is mainly described.

Meanwhile, the OLED panel exhibits a faster response speed than the LED and has excellent color reproduction.

Accordingly, if the display 180 includes an OLED panel, it is preferable that the signal processor 170 (see FIG. 2) of the image display apparatus 100 perform image quality processing for the OLED panel.

Meanwhile, in the case in which the gray level of an input image is low in the state in which the display 180 is an organic light emitting diode panel, it is difficult to visually distinguish between dark portions.

Consequently, the present disclosure provides a signal processing device 170 (see FIG. 2) capable of improving low gray level expression of an organic light emitting diode panel and an image display apparatus 100 including the same.

In addition, the present disclosure provides a signal processing device 170 (see FIG. 2) capable of improving low gray level expression of an organic light emitting diode panel based on ambient illuminance and an image display apparatus 100 including the same.

That is, an image display apparatus 100 according to an embodiment of the present invention may perform luminance conversion based on a first luminance conversion pattern CVr in the case in which the luminance level of an input image is greater a first level ltha, and may perform luminance conversion based on a second luminance conversion pattern CV1, which has a higher luminance level than the first luminance conversion pattern CVr, in the case in which the luminance level of the input image is equal to or less than the first level ltha. Consequently, it is possible to improve low gray level expression of an organic light emitting diode panel 210. As a result, it is easy to visually distinguish between dark portions in the input image.

Meanwhile, an image display apparatus 100 according to an embodiment of the present invention may perform control such that the first level ltha is changed based on sensed illuminance. Consequently, it is possible to improve low gray level expression of the organic light emitting diode panel 210 based on ambient illuminance.

Meanwhile, an image display apparatus 100 according to another embodiment of the present invention may insert a predetermined pattern into an input image, may change the luminance level of the pattern, perform luminance conversion based on a first luminance conversion pattern CVr in the case in which the luminance level of the pattern is greater a first level ltha, and may perform luminance conversion based on a second luminance conversion pattern CV1, which has a higher luminance level than the first luminance conversion pattern CVr, in the case in which the luminance level of the pattern is equal to or less than a first level ltha. Consequently, it is possible to improve low gray level expression of the organic light emitting diode panel 210. As a result, it is easy to visually distinguish between dark portions in the input image.

Meanwhile, an image display apparatus 100 according to another embodiment of the present invention may perform uniform-rate luminance conversion based on a first luminance conversion pattern CVr in the case in which the luminance level of the pattern is greater a first level ltha, and may perform luminance conversion based on a second luminance conversion pattern CV1, the rate of which is not uniform, in the case in which the luminance level of the pattern is equal to or less than a first level ltha. In the case in which the luminance level in the organic light emitting diode panel 210 is equal to or less than a first level ltha, therefore, it is possible to improve low gray level expression.

Meanwhile, the image display apparatus 100 in FIG. 1 may be a TV, a monitor, a tablet PC, a mobile terminal, etc.

Figure 2:
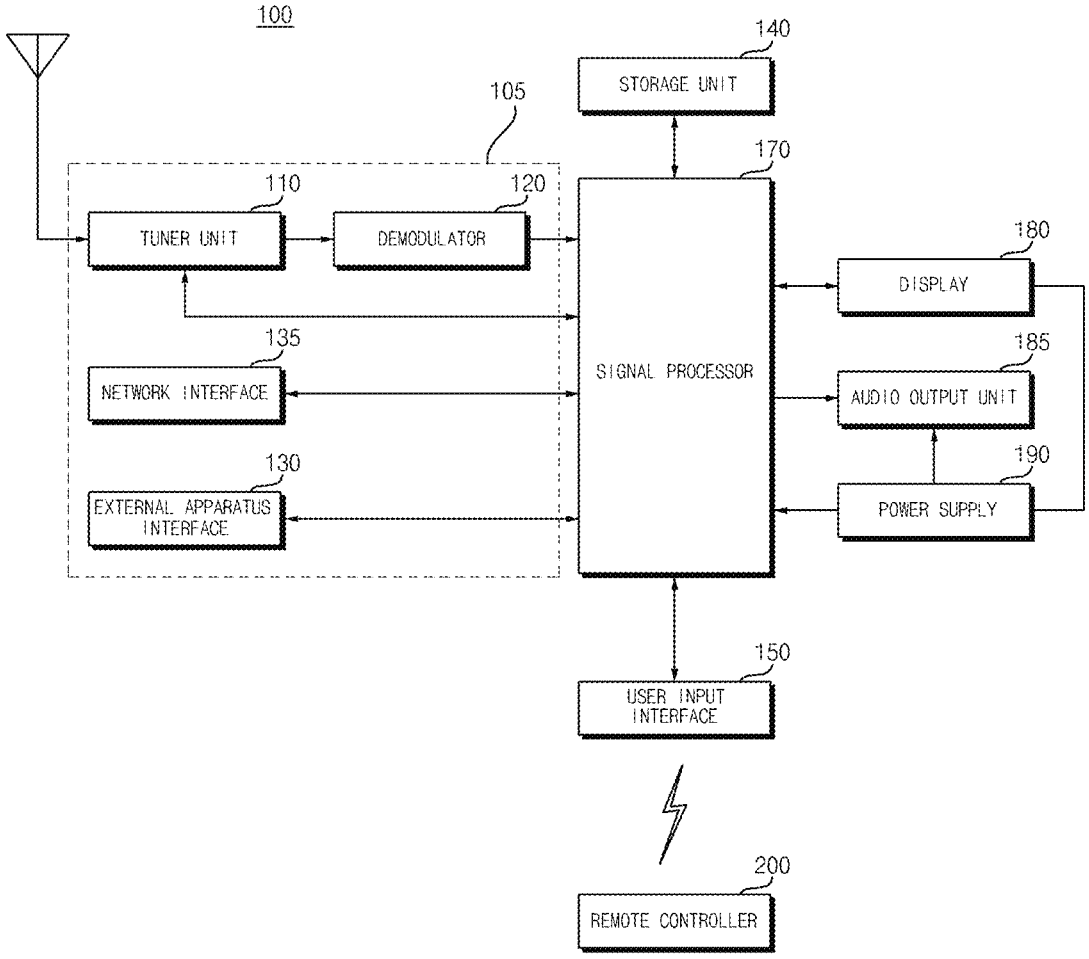
FIG. 2 is an example of an internal block diagram of the image display apparatus of FIG. 1.

FIG. 2 is an example of an internal block diagram of the image display apparatus of FIG. 1.

Referring to FIG. 2, the image display apparatus 100 according to an embodiment of the present disclosure includes an image receiver 105, an external apparatus interface 130, a storage unit 140, a user input interface 150, a sensor unit (not shown), a signal processor 170, a display 180, and an audio output unit 185.

The image receiver 105 may include a tuner unit 110, a demodulator 120, a network interface 135, and an external apparatus interface 130.

Meanwhile, unlike the drawing, the image receiver 105 may include only the tuner unit 110, the demodulator 120, and the external apparatus interface 130. That is, the network interface 135 may not be included.

The tuner unit 110 selects an RF broadcast signal corresponding to a channel selected by a user or all pre-stored channels among radio frequency (RF) broadcast signals received through an antenna (not shown). In addition, the selected RF broadcast signal is converted into an intermediate frequency signal, a baseband image, or an audio signal.

For example, if the selected RF broadcast signal is a digital broadcast signal, it is converted into a digital IF signal (DIF). If the selected RF broadcast signal is an analog broadcast signal, it is converted into an analog baseband image or audio signal (CVBS/SIF). That is, the tuner unit 110 can process a digital broadcast signal or an analog broadcast signal. The analog baseband image or audio signal (CVBS/SIF) output from the tuner unit 110 may be directly input to the signal processor 170.

Meanwhile, the tuner unit 110 can include a plurality of tuners for receiving broadcast signals of a plurality of channels. Alternatively, a single tuner that simultaneously receives broadcast signals of a plurality of channels is also available.

The demodulator 120 receives the converted digital IF signal DIF from the tuner unit 110 and performs a demodulation operation.

The demodulator 120 may perform demodulation and channel decoding and then output a stream signal TS. At this time, the stream signal may be a multiplexed signal of an image signal, an audio signal, or a data signal.

The stream signal output from the demodulator 120 may be input to the signal processor 170. The signal processor 170 performs demultiplexing, image/audio signal processing, and the like, and then outputs an image to the display 180 and outputs audio to the audio output unit 185. In some implementations, the signal processor 170 corresponds to a hardware processor. In some implementations, the signal processor 170 corresponds to a system on chip (SOC).

The external apparatus interface 130 may transmit or receive data with a connected external apparatus (not shown), e.g., a set-top box 50. To this end, the external apparatus interface 130 may include an A/V input and output unit (not shown).

The external apparatus interface 130 may be connected in wired or wirelessly to an external apparatus such as a digital versatile disk (DVD), a Blu ray, a game equipment, a camera, a camcorder, a computer (note book), and a set-top box, and may perform an input/output operation with an external apparatus.

The A/V input and output unit may receive image and audio signals from an external apparatus. Meanwhile, a wireless communicator (not shown) may perform short-range wireless communication with other electronic apparatus.

Through the wireless communicator (not shown), the external apparatus interface 130 may exchange data with an adjacent mobile terminal 600. In particular, in a mirroring mode, the external apparatus interface 130 may receive device information, executed application information, application image, and the like from the mobile terminal 600.

The network interface 135 provides an interface for connecting the image display apparatus 100 to a wired/wireless network including the Internet network. For example, the network interface 135 may receive, via the network, content or data provided by the Internet, a content provider, or a network operator.

Meanwhile, the network interface 135 may include a wireless communicator (not shown).

The storage unit 140 may store a program for each signal processing and control in the signal processor 170, and may store signal-processed image, audio, or data signal.

In addition, the storage unit 140 may serve to temporarily store image, audio, or data signal input to the external apparatus interface 130. In addition, the storage unit 140 may store information on a certain broadcast channel through a channel memory function such as a channel map.

Although FIG. 2 illustrates that the storage unit is provided separately from the signal processor 170, the scope of the present disclosure is not limited thereto. The storage unit 140 may be included in the signal processor 170.

The user input interface 150 transmits a signal input by the user to the signal processor 170 or transmits a signal from the signal processor 170 to the user.

For example, it may transmit/receive a user input signal such as power on/off, channel selection, screen setting, etc., from a remote controller 200, may transfer a user input signal input from a local key (not shown) such as a power key, a channel key, a volume key, a set value, etc., to the signal processor 170, may transfer a user input signal input from a sensor unit (not shown) that senses a user's gesture to the signal processor 170, or may transmit a signal from the signal processor 170 to the sensor unit (not shown).

The signal processor 170 may demultiplex the input stream through the tuner unit 110, the demodulator 120, the network interface 135, or the external apparatus interface 130, or process the demultiplexed signals to generate and output a signal for image or audio output.

For example, the signal processor 170 receives a broadcast signal received by the image receiver 105 or an HDMI signal, and perform signal processing based on the received broadcast signal or the HDMI signal to thereby output a processed image signal.

The image signal processed by the signal processor 170 is input to the display 180, and may be displayed as an image corresponding to the image signal. In addition, the image signal processed by the signal processor 170 may be input to the external output apparatus through the external apparatus interface 130.

The audio signal processed by the signal processor 170 may be output to the audio output unit 185 as an audio signal. In addition, audio signal processed by the signal processor 170 may be input to the external output apparatus through the external apparatus interface 130.

Although not shown in FIG. 2, the signal processor 170 may include a demultiplexer, an image processor, and the like. That is, the signal processor 170 may perform a variety of signal processing and thus it may be implemented in the form of a system on chip (SOC). This will be described later with reference to FIG. 3.

In addition, the signal processor 170 can control the overall operation of the image display apparatus 100. For example, the signal processor 170 may control the tuner unit 110 to control the tuning of the RF broadcast corresponding to the channel selected by the user or the previously stored channel.

In addition, the signal processor 170 may control the image display apparatus 100 according to a user command input through the user input interface 150 or an internal program.

Meanwhile, the signal processor 170 may control the display 180 to display an image. At this time, the image displayed on the display 180 may be a still image or a moving image, and may be a 2D image or a 3D image.

Meanwhile, the signal processor 170 may display a certain object in an image displayed on the display 180. For example, the object may be at least one of a connected web screen (newspaper, magazine, etc.), an electronic program guide (EPG), various menus, a widget, an icon, a still image, a moving image, and a text.

Meanwhile, the signal processor 170 may recognize the position of the user based on the image photographed by a photographing unit (not shown). For example, the distance (z-axis coordinate) between a user and the image display apparatus 100 can be determined. In addition, the x-axis coordinate and the y-axis coordinate in the display 180 corresponding to a user position can be determined.

The display 180 generates a driving signal by converting an image signal, a data signal, an OSD signal, a control signal processed by the signal processor 170, an image signal, a data signal, a control signal, and the like received from the external apparatus interface 130.

Meanwhile, the display 180 may be configured as a touch screen and used as an input device in addition to an output device.

The audio output unit 185 receives a signal processed by the signal processor 170 and outputs it as an audio.

The photographing unit (not shown) photographs a user. The photographing unit (not shown) may be implemented by a single camera, but the present disclosure is not limited thereto and may be implemented by a plurality of cameras. Image information photographed by the photographing unit (not shown) may be input to the signal processor 170.

The signal processor 170 may sense a gesture of the user based on each of the images photographed by the photographing unit (not shown), the signals detected from the sensor unit (not shown), or a combination thereof.

The power supply 190 supplies corresponding power to the image display apparatus 100. Particularly, the power may be supplied to a controller 170 which can be implemented in the form of a system on chip (SOC), a display 180 for displaying an image, and an audio output unit 185 for outputting an audio.

Specifically, the power supply 190 may include a converter for converting an AC power into a DC power, and a DC/DC converter for converting the level of the DC power.

The remote controller 200 transmits the user input to the user input interface 150. To this end, the remote controller 200 may use Bluetooth, a radio frequency (RF) communication, an infrared (IR) communication, an Ultra Wideband (UWB), ZigBee, or the like. In addition, the remote controller 200 may receive the image, audio, or data signal output from the user input interface 150, and display it on the remote controller 200 or output it as an audio.

Meanwhile, the image display apparatus 100 may be a fixed or mobile digital broadcasting receiver capable of receiving digital broadcasting.

Meanwhile, a block diagram of the image display apparatus 100 shown in FIG. 2 is a block diagram for an embodiment of the present disclosure. Each component of the block diagram may be integrated, added, or omitted according to a specification of the image display apparatus 100 actually implemented. That is, two or more components may be combined into a single component as needed, or a single component may be divided into two or more components. The function performed in each block is described for the purpose of illustrating embodiments of the present disclosure, and specific operation and apparatus do not limit the scope of the present disclosure.

Figure 3:
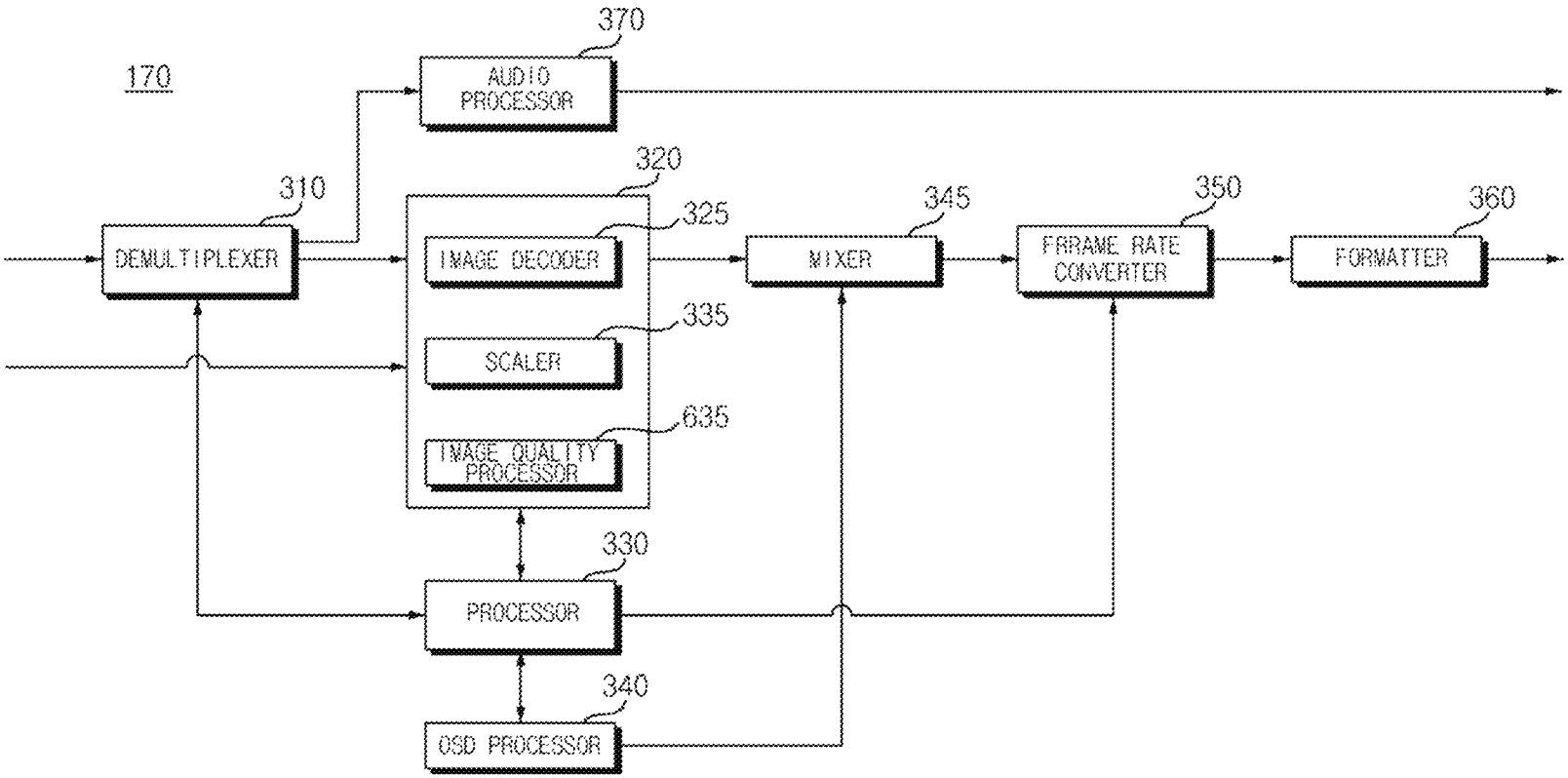
FIG. 3 is an example of an internal block diagram of a signal processor of FIG. 2.

FIG. 3 is an example of an internal block diagram of the signal processor in FIG. 2.

Referring to the figure, the signal processor 170 according to an embodiment of the present disclosure may include a demultiplexer 310, an image processor 320, a processor 330, and an audio processor 370. In addition, the signal processor 170 may further include and a data processor (not shown).

The demultiplexer 310 demultiplexes the input stream. For example, when an MPEG-2 TS is input, it can be demultiplexed into image, audio, and data signal, respectively. Here, the stream signal input to the demultiplexer 310 may be a stream signal output from the tuner unit 110, the demodulator 120, or the external apparatus interface 130.

The image processor 320 may perform signal processing on an input image. For example, the image processor 320 may perform image processing on an image signal demultiplexed by the demultiplexer 310.

To this end, the image processor 320 may include an image decoder 325, a scaler 335, an image quality processor 635, an image encoder (not shown), an OSD processor 340, a frame rate converter 350, a formatter 360, etc.

The image decoder 325 decodes a demultiplexed image signal, and the scaler 335 performs scaling so that the resolution of the decoded image signal can be output from the display 180.

The image decoder 325 can include a decoder of various standards. For example, a 3D image decoder for MPEG-2, H.264 decoder, a color image, and a depth image, and a decoder for a multiple view image may be provided.

The scaler 335 may scale an input image signal decoded by the image decoder 325 or the like.

For example, if the size or resolution of an input image signal is small, the scaler 335 may upscale the input image signal, and, if the size or resolution of the input image signal is great, the scaler 335 may downscale the input image signal.

The image quality processor 635 may perform image quality processing on an input image signal decoded by the image decoder 325 or the like.

For example, the image quality processor 625 may perform noise reduction processing on an input image signal, extend a resolution of high gray level of the input image signal, perform image resolution enhancement, perform high dynamic range (HDR)-based signal processing, change a frame rate, perform image quality processing suitable for properties of a panel, especially an OLED panel, etc.

The OSD processor 340 generates an OSD signal according to a user input or by itself. For example, based on a user input signal, the OSD processor 340 may generate a signal for displaying various information as a graphic or a text on the screen of the display 180. The generated OSD signal may include various data such as a user interface screen of the image display apparatus 100, various menu screens, a widget, and an icon. In addition, the generated OSD signal may include a 2D object or a 3D object.

In addition, the OSD processor 340 may generate a pointer that can be displayed on the display, based on a pointing signal input from the remote controller 200. In particular, such a pointer may be generated by a pointing signal processor, and the OSD processor 340 may include such a pointing signal processor (not shown). Obviously, the pointing signal processor (not shown) may be provided separately from the OSD processor 340.

The frame rate converter (FRC) 350 may convert the frame rate of an input image. Meanwhile, the frame rate converter 350 can also directly output the frame rate without any additional frame rate conversion.

Meanwhile, the formatter 360 may change a format of an input image signal into a format suitable for displaying the image signal on a display and output the image signal in the changed format.

In particular, the formatter 360 may change a format of an image signal to correspond to a display panel.

Meanwhile, the formatter 360 may change the format of the image signal. For example, it may change the format of the 3D image signal into any one of various 3D formats such as a side by side format, a top/down format, a frame sequential format, an interlaced format, a checker box format, and the like.

The processor 330 may control overall operations of the image display apparatus 100 or the signal processor 170.

For example, the processor 330 may control the tuner unit 110 to control the tuning of an RF broadcast corresponding to a channel selected by a user or a previously stored channel.

In addition, the processor 330 may control the image display apparatus 100 according to a user command input through the user input interface 150 or an internal program.

In addition, the processor 330 may transmit data to the network interface 135 or to the external apparatus interface 130.

In addition, the processor 330 may control the demultiplexer 310, the image processor 320, and the like in the signal processor 170.

Meanwhile, the audio processor 370 in the signal processor 170 may perform the audio processing of the demultiplexed audio signal. To this end, the audio processor 370 may include various decoders.

In addition, the audio processor 370 in the signal processor 170 may process a base, a treble, a volume control, and the like.

The data processor (not shown) in the signal processor 170 may perform data processing of the demultiplexed data signal. For example, when the demultiplexed data signal is a coded data signal, it can be decoded. The encoded data signal may be electronic program guide information including broadcast information such as a start time and an end time of a broadcast program broadcasted on each channel.

Meanwhile, a block diagram of the signal processor 170 shown in FIG. 3 is a block diagram for an embodiment of the present disclosure. Each component of the block diagram may be integrated, added, or omitted according to a specification of the signal processor 170 actually implemented.

In particular, the frame rate converter 350 and the formatter 360 may be provided separately in addition to the image processor 320.

Figure 4A:
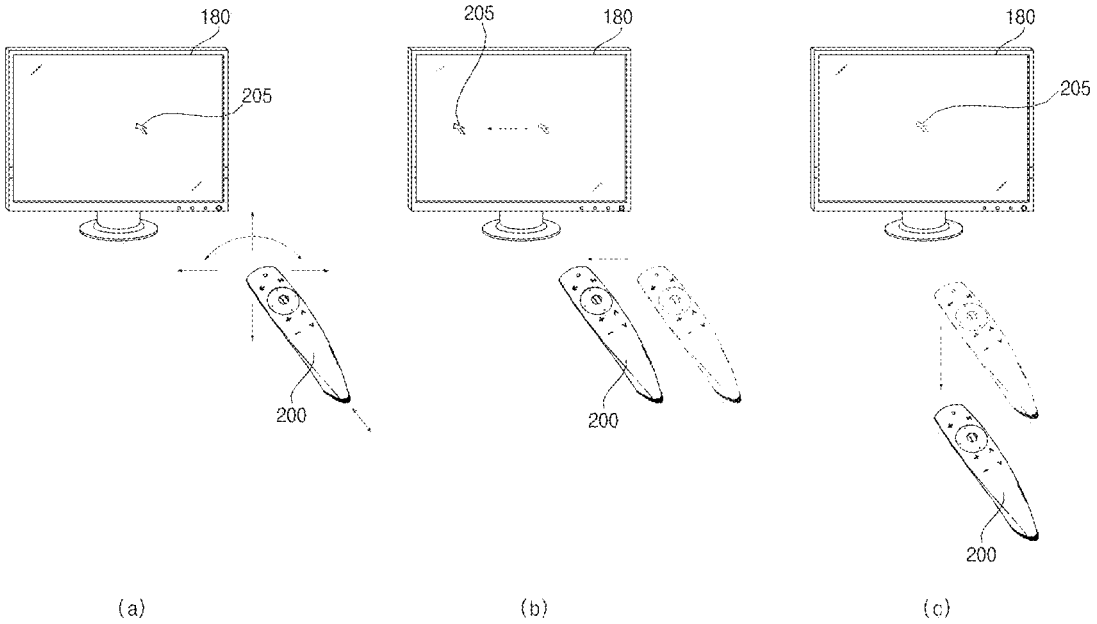
FIG. 4A is a diagram showing a control method of a remote controller of FIG. 2.

FIG. 4A is a diagram illustrating a control method of a remote controller of FIG. 2.

As shown in FIG. 4A(a), it is illustrated that a pointer 205 corresponding to the remote controller 200 is displayed on the display 180.

The user may move or rotate the remote controller 200 up and down, left and right (FIG. 4A(b)), and back and forth (FIG. 4A(c)). The pointer 205 displayed on the display 180 of the image display apparatus corresponds to the motion of the remote controller 200. Such a remote controller 200 may be referred to as a space remote controller or a 3D pointing apparatus, because the pointer 205 is moved and displayed according to the movement in a 3D space, as shown in the drawing.

FIG. 4A(b) illustrates that when the user moves the remote controller 200 to the left, the pointer 205 displayed on the display 180 of the image display apparatus also moves to the left correspondingly.

Information on the motion of the remote controller 200 detected through a sensor of the remote controller 200 is transmitted to the image display apparatus. The image display apparatus may calculate the coordinate of the pointer 205 from the information on the motion of the remote controller 200. The image display apparatus may display the pointer 205 to correspond to the calculated coordinate.

FIG. 4A(c) illustrates a case where the user moves the remote controller 200 away from the display 180 while pressing a specific button of the remote controller 200. Thus, a selection area within the display 180 corresponding to the pointer 205 may be zoomed in so that it can be displayed to be enlarged. On the other hand, when the user moves the remote controller 200 close to the display 180, the selection area within the display 180 corresponding to the pointer 205 may be zoomed out so that it can be displayed to be reduced. Meanwhile, when the remote controller 200 moves away from the display 180, the selection area may be zoomed out, and when the remote controller 200 approaches the display 180, the selection area may be zoomed in.

Meanwhile, when the specific button of the remote controller 200 is pressed, it is possible to exclude the recognition of vertical and lateral movement. That is, when the remote controller 200 moves away from or approaches the display 180, the up, down, left, and right movements are not recognized, and only the forward and backward movements are recognized. Only the pointer 205 is moved according to the up, down, left, and right movements of the remote controller 200 in a state where the specific button of the remote controller 200 is not pressed.

Meanwhile, the moving speed or the moving direction of the pointer 205 may correspond to the moving speed or the moving direction of the remote controller 200.

Figure 4B:
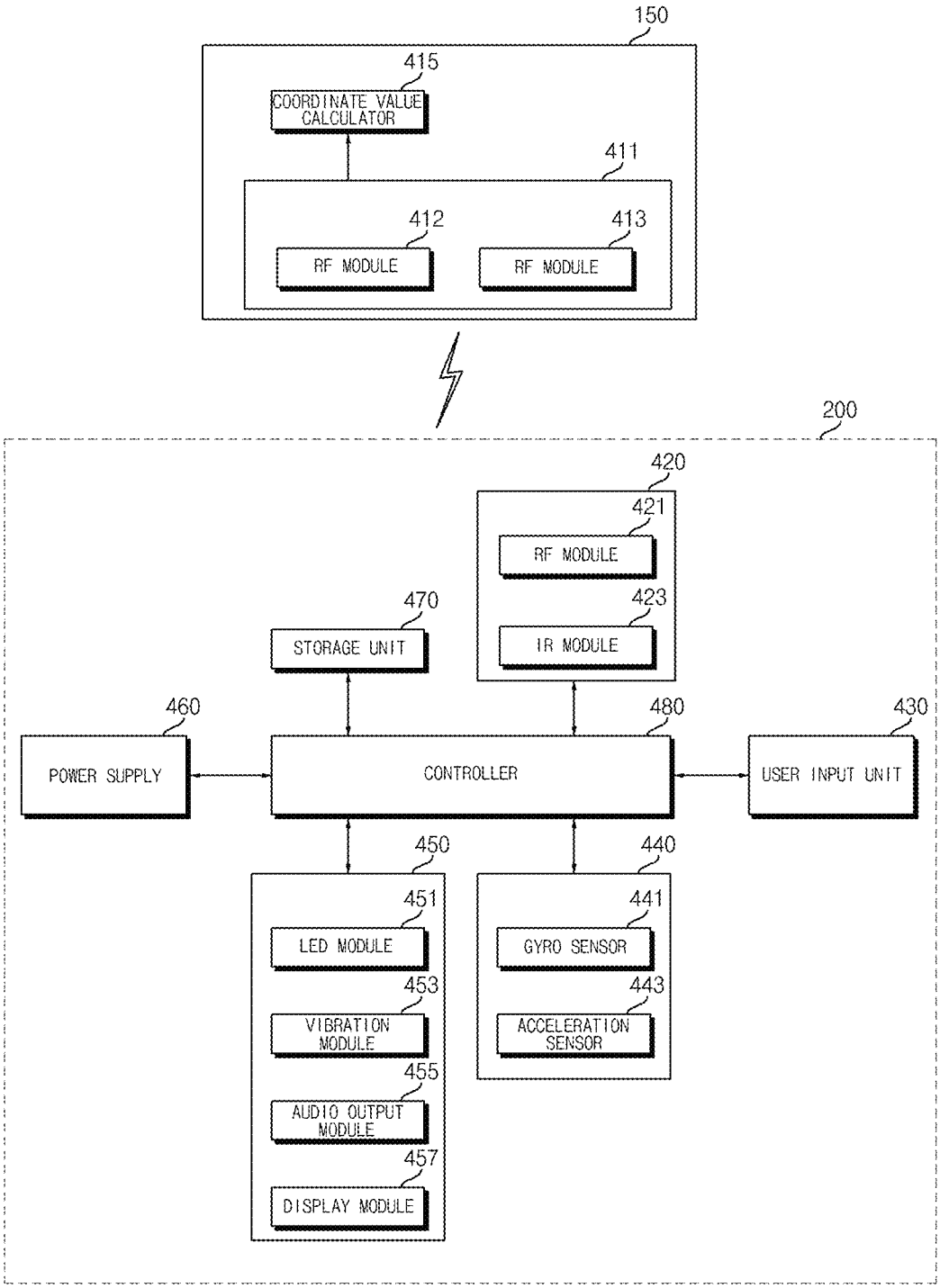
FIG. 4B is an internal block diagram of the remote controller of FIG. 2.

FIG. 4B is an internal block diagram of the remote controller of FIG. 2.

Referring to the figure, the remote controller 200 includes a wireless communicator 425, a user input unit 435, a sensor unit 440, an output unit 450, a power supply 460, a storage unit 470, and a controller 480.

The wireless communicator 425 transmits/receives a signal to/from any one of the image display apparatuses according to the embodiments of the present disclosure described above. Among the image display apparatuses according to the embodiments of the present disclosure, one image display apparatus 100 will be described as an example.

In the present embodiment, the remote controller 200 may include an RF module 421 for transmitting and receiving signals to and from the image display apparatus 100 according to a RF communication standard. In addition, the remote controller 200 may include an IR module 423 for transmitting and receiving signals to and from the image display apparatus 100 according to a IR communication standard.

In the present embodiment, the remote controller 200 transmits a signal containing information on the motion of the remote controller 200 to the image display apparatus 100 through the RF module 421.

In addition, the remote controller 200 may receive the signal transmitted by the image display apparatus 100 through the RF module 421. In addition, if necessary, the remote controller 200 may transmit a command related to power on/off, channel change, volume change, and the like to the image display apparatus 100 through the IR module 423.

The user input unit 435 may be implemented by a keypad, a button, a touch pad, a touch screen, or the like. The user may operate the user input unit 435 to input a command related to the image display apparatus 100 to the remote controller 200. When the user input unit 435 includes a hard key button, the user can input a command related to the image display apparatus 100 to the remote controller 200 through a push operation of the hard key button. When the user input unit 435 includes a touch screen, the user may touch a soft key of the touch screen to input the command related to the image display apparatus 100 to the remote controller 200. In addition, the user input unit 435 may include various types of input means such as a scroll key, a jog key, etc., which can be operated by the user, and the present disclosure does not limit the scope of the present disclosure.

The sensor unit 440 may include a gyro sensor 441 or an acceleration sensor 443. The gyro sensor 441 may sense information about the motion of the remote controller 200.

For example, the gyro sensor 441 may sense information on the operation of the remote controller 200 based on the x, y, and z axes. The acceleration sensor 443 may sense information on the moving speed of the remote controller 200. Meanwhile, a distance measuring sensor may be further provided, and thus, the distance to the display 180 may be sensed.

The output unit 450 may output an image or an audio signal corresponding to the operation of the user input unit 435 or a signal transmitted from the image display apparatus 100. Through the output unit 450, the user may recognize whether the user input unit 435 is operated or whether the image display apparatus 100 is controlled.

For example, the output unit 450 may include an LED module 451 that is turned on when the user input unit 435 is operated or a signal is transmitted/received to/from the image display apparatus 100 through the wireless communicator 425, a vibration module 453 for generating a vibration, an audio output module 455 for outputting an audio, or a display module 457 for outputting an image.

The power supply 460 supplies power to the remote controller 200. When the remote controller 200 is not moved for a certain time, the power supply 460 may stop the supply of power to reduce a power waste. The power supply 460 may resume power supply when a certain key provided in the remote controller 200 is operated.

The storage unit 470 may store various types of programs, application data, and the like necessary for the control or operation of the remote controller 200. If the remote controller 200 wirelessly transmits and receives a signal to/from the image display apparatus 100 through the RF module 421, the remote controller 200 and the image display apparatus 100 transmit and receive a signal through a certain frequency band. The controller 480 of the remote controller 200 may store information about a frequency band or the like for wirelessly transmitting and receiving a signal to/from the image display apparatus 100 paired with the remote controller 200 in the storage unit 470 and may refer to the stored information.

The controller 480 controls various matters related to the control of the remote controller 200. The controller 480 may transmit a signal corresponding to a certain key operation of the user input unit 435 or a signal corresponding to the motion of the remote controller 200 sensed by the sensor unit 440 to the image display apparatus 100 through the wireless communicator 425.

The user input interface 150 of the image display apparatus 100 includes a wireless communicator 151 that can wirelessly transmit and receive a signal to and from the remote controller 200 and a coordinate value calculator 415 that can calculate the coordinate value of a pointer corresponding to the operation of the remote controller 200.

The user input interface 150 may wirelessly transmit and receive a signal to and from the remote controller 200 through the RF module 412. In addition, the user input interface 150 may receive a signal transmitted by the remote controller 200 through the IR module 413 according to a IR communication standard.

The coordinate value calculator 415 may correct a hand shake or an error from a signal corresponding to the operation of the remote controller 200 received through the wireless communicator 151 and calculate the coordinate value (x, y) of the pointer 205 to be displayed on the display 180.

The transmission signal of the remote controller 200 inputted to the image display apparatus 100 through the user input interface 150 is transmitted to the controller 180 of the image display apparatus 100. The controller 180 may determine the information on the operation of the remote controller 200 and the key operation from the signal transmitted from the remote controller 200, and, correspondingly, control the image display apparatus 100.

For another example, the remote controller 200 may calculate the pointer coordinate value corresponding to the operation and output it to the user input interface 150 of the image display apparatus 100. In this case, the user input interface 150 of the image display apparatus 100 may transmit information on the received pointer coordinate value to the controller 180 without a separate correction process of hand shake or error.

For another example, unlike the drawing, the coordinate value calculator 415 may be provided in the signal processor 170, not in the user input interface 150.

Figure 5:
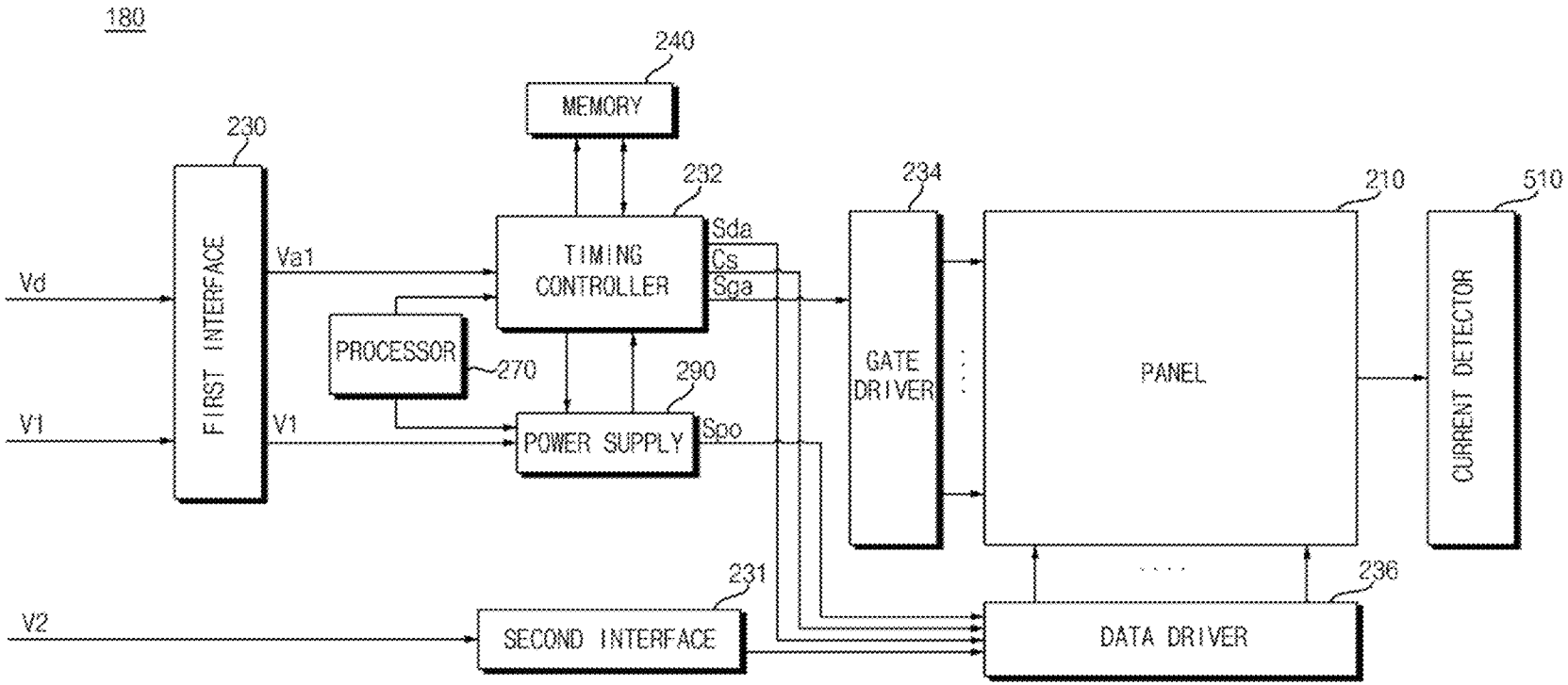
FIG. 5 is an example of an internal block diagram of a display of FIG. 2.

FIG. 5 is an internal block diagram of a display of FIG. 2.

Referring to the figure, the organic light emitting diode panel-based display 180 may include an organic light emitting diode panel 210, a first interface 230, a second interface 231, a timing controller 232, a gate driver 234, a data driver 236, a memory 240, a processor 270, a power supply 290, a current detector 510, and the like.

The display 180 receives an image signal Vd, a first DC power V1, and a second DC power V2, and may display a certain image based on the image signal Vd.

Meanwhile, the first interface 230 in the display 180 may receive the image signal Vd and the first DC power V1 from the signal processor 170.

Here, the first DC power V1 may be used for the operation of the power supply 290 and the timing controller 232 in the display 180.

Next, the second interface 231 may receive a second DC power V2 from an external power supply 190. Meanwhile, the second DC power V2 may be input to the data driver 236 in the display 180.

The timing controller 232 may output a data driving signal Sda and a gate driving signal Sga, based on the image signal Vd.

For example, when the first interface 230 converts the input image signal Vd and outputs the converted image signal val, the timing controller 232 may output the data driving signal Sda and the gate driving signal Sga based on the converted image signal val.

The timing controller 232 may further receive a control signal, a vertical synchronization signal Vsync, and the like, in addition to the image signal Vd from the signal processor 170.

In addition to the image signal Vd, based on a control signal, a vertical synchronization signal Vsync, and the like, the timing controller 232 generates a gate driving signal Sga for the operation of the gate driver 234, and a data driving signal Sda for the operation of the data driver 236.

At this time, when the panel 210 includes a RGBW subpixel, the data driving signal Sda may be a data driving signal for driving of RGBW subpixel.

Meanwhile, the timing controller 232 may further output a control signal Cs to the gate driver 234.

The gate driver 234 and the data driver 236 supply a scan signal and an image signal to the organic light emitting diode panel 210 through a gate line GL and a data line DL respectively, according to the gate driving signal Sga and the data driving signal Sda from the timing controller 232. Accordingly, the organic light emitting diode panel 210 displays a certain image.

Meanwhile, the organic light emitting diode panel 210 may include an organic light emitting layer. In order to display an image, a plurality of gate lines GL and data lines DL may be disposed in a matrix form in each pixel corresponding to the organic light emitting layer.

Meanwhile, the data driver 236 may output a data signal to the organic light emitting diode panel 210 based on a second DC power V2 from the second interface 231.

The power supply 290 may supply various power supplies to the gate driver 234, the data driver 236, the timing controller 232, and the like.

The current detector 510 may detect the current flowing in a sub-pixel of the organic light emitting diode panel 210. The detected current may be input to the processor 270 or the like, for a cumulative current calculation.

The processor 270 may perform each type of control of the display 180. For example, the processor 270 may control the gate driver 234, the data driver 236, the timing controller 232, and the like.

Meanwhile, the processor 270 may receive current information flowing in a sub-pixel of the organic light emitting diode panel 210 from the current detector 510.

In addition, the processor 270 may calculate the accumulated current of each subpixel of the organic light emitting diode panel 210, based on information of current flowing through the subpixel of the organic light emitting diode panel 210. The calculated accumulated current may be stored in the memory 240.

Meanwhile, the processor 270 may determine as burn-in, if the accumulated current of each sub-pixel of the organic light emitting diode panel 210 is equal to or greater than an allowable value.

For example, if the accumulated current of each subpixel of the OLED panel 210 is equal to or higher than 300000 A, the processor 270 may determine that a corresponding subpixel is a burn-in subpixel.

Meanwhile, if the accumulated current of each subpixel of the OLED panel 210 is close to an allowable value, the processor 270 may determine that a corresponding subpixel is a subpixel expected to be burn in.

Meanwhile, based on a current detected by the current detector 510, the processor 270 may determine that a sub-pixel having the greatest accumulated current is an expected burn-in subpixel.

Figure 6A:
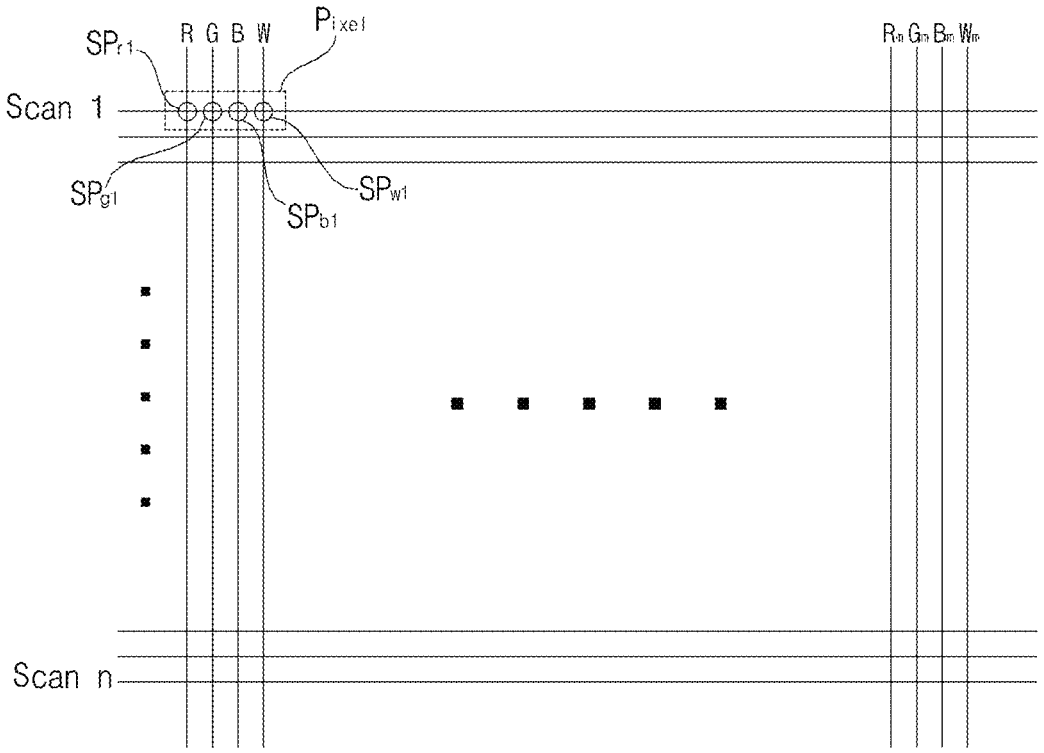
FIG. 6A and FIG. 6B are diagrams referred to in the description of an organic light emitting diode panel of FIG. 5.
Figure 6B:
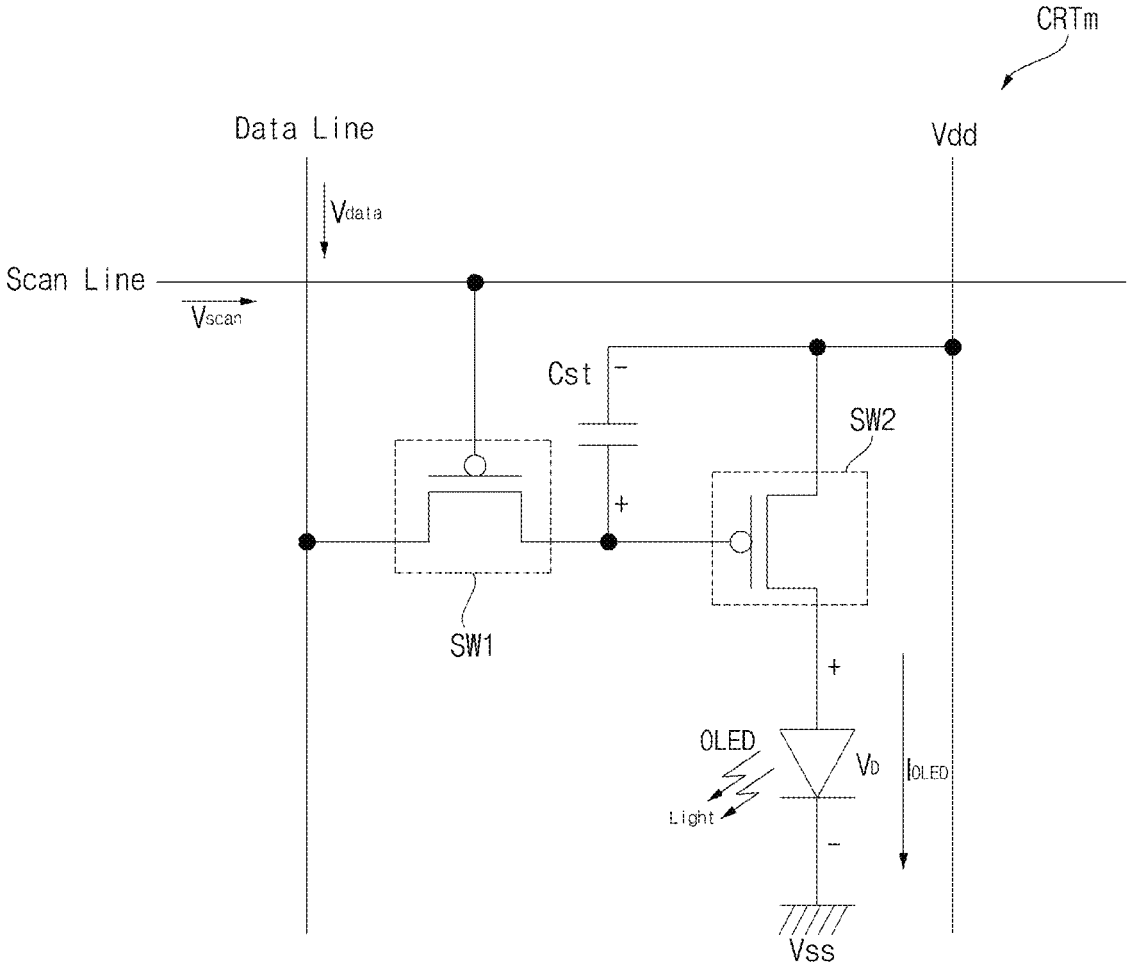

FIG. 6A and FIG. 6B are diagrams referred to in the description of an organic light emitting diode panel of FIG. 5.

First, FIG. 6A is a diagram illustrating a pixel in the organic light emitting diode panel 210.

Referring to the figure, the organic light emitting diode panel 210 may include a plurality of scan lines Scan1 to Scann and a plurality of data lines R1, G1, B1, and W1 to Rm, Gm, Bm, and Wm intersecting the scan lines.

Meanwhile, a pixel (subpixel) is defined in an intersecting area of the scan line and the data line in the organic light emitting diode panel 210. In the drawing, a pixel including sub-pixels SR1, SG1, SB1 and SW1 of RGBW is shown.

FIG. 6B illustrates a circuit of any one sub-pixel in the pixel of the organic light emitting diode panel of FIG. 6A.

Referring to drawing, an organic light emitting sub pixel circuit (CRTm) may include, as an active type, a scan switching element SW1, a storage capacitor Cst, a drive switching element SW2, and an organic light emitting layer (OLED).

The scan switching element SW1 is turned on according to the input scan signal Vdscan, as a scan line is connected to a gate terminal. When it is turned on, the input data signal Vdata is transferred to the gate terminal of a drive switching element SW2 or one end of the storage capacitor Cst.

The storage capacitor Cst is formed between the gate terminal and the source terminal of the drive switching element SW2, and stores a certain difference between a data signal level transmitted to one end of the storage capacitor Cst and a DC power (VDD) level transmitted to the other terminal of the storage capacitor Cst.

For example, when the data signal has a different level according to a Plume Amplitude Modulation (PAM) method, the power level stored in the storage capacitor Cst varies according to the level difference of the data signal Vdata.

For another example, when the data signal has a different pulse width according to a Pulse Width Modulation (PWM) method, the power level stored in the storage capacitor Cst varies according to the pulse width difference of the data signal Vdata.

The drive switching element SW2 is turned on according to the power level stored in the storage capacitor Cst. When the drive switching element SW2 is turned on, the driving current (IOLED), which is proportional to the stored power level, flows in the organic light emitting layer (OLED). Accordingly, the organic light emitting layer OLED performs a light emitting operation.

The organic light emitting layer OLED may include a light emitting layer (EML) of RGBW corresponding to a subpixel, and may include at least one of a hole injecting layer (HIL), a hole transporting layer (HTL), an electron transporting layer (ETL), and an electron injecting layer (EIL). In addition, it may include a hole blocking layer, and the like.

Meanwhile, all the subpixels emit a white light in the organic light emitting layer OLED. However, in the case of green, red, and blue subpixels, a subpixel is provided with a separate color filter for color implementation. That is, in the case of green, red, and blue subpixels, each of the subpixels further includes green, red, and blue color filters. Meanwhile, since a white subpixel outputs a white light, a separate color filter is not required.

Meanwhile, in the drawing, it is illustrated that a p-type MOSFET is used for a scan switching element SW1 and a drive switching element SW2, but an n-type MOSFET or other switching element such as a JFET, IGBT, SIC, or the like are also available.

Meanwhile, the pixel is a hold-type element that continuously emits light in the organic light emitting layer (OLED), after a scan signal is applied, during a unit display period, specifically, during a unit frame.

Meanwhile, with development of camera and broadcasting technologies, resolution and vertical synchronization frequencies for input images have improved as well. In particular, there is increasing need of image quality processing on an image signal having 4K resolution and 120 Hz vertical synchronization frequency. Accordingly, a method of improving image quality processing of an input image signal is proposed. A detailed description thereof is hereinafter provided with reference to FIG. 7 and other drawings.

Figure 7:
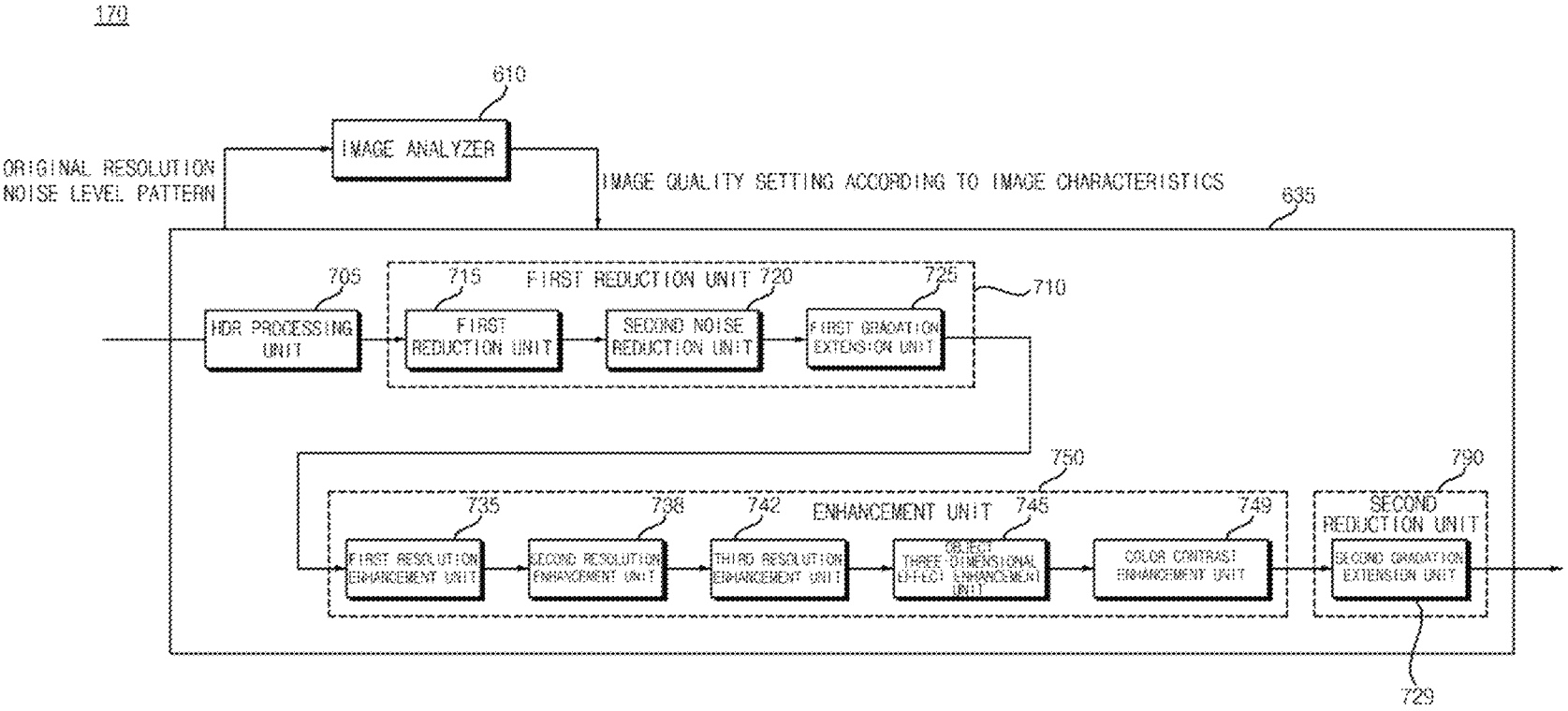
FIG. 7 is an example of an internal block diagram of a signal processing device.

FIG. 7 is an example of an internal block diagram of a signal processing device according to an embodiment of the present disclosure.

Meanwhile, a signal processing device 170 in FIG. 7 may correspond to the signal processor 170 in FIG. 2.

First, referring to FIG. 7, the signal processing device 170 according to an embodiment of the present disclosure may include an image analyzer 610 and an image quality processor 635.

The image analyzer 610 may analyze an input image signal, and output information related to the analyzed input image signal.

Meanwhile, the image analyzer 610 may differentiate an object region and a background region of a first input image signal. Alternatively, the image analyzer 610 may calculate a probability or percentage of the object region and the background region of the first input image signal.

The input image signal may be an input image signal from an image receiver 105 or an image decoded by the image decoder 320 in FIG. 3.

In particular, the image analyzer 610 may analyze an input image signal using artificial intelligence (AI), and output information on the analyzed input image signal.

Specifically, the image analyzer 610 may output a resolution, gray level, a noise level, and a pattern of an input image signal, and output information on the analyzed input image signal, especially image setting information, to the image quality processor 635.

The image quality processor 635 may include an HDR processor 705, a first reduction unit 710, an enhancement unit 750, and a second reduction unit 790.

The HDR processor 705 may receive an image signal and perform high dynamic range (HDR) processing on the input image signal.

For example, the HDR processor 705 may convert a standard dynamic range (SDR) image signal into an HDR image signal.

For another example, the HDR processor 705 may receive an image signal, and perform gray level processing on the input image signal for an HDR.

Meanwhile, if an input image signal is an SDR image signal, the HDR processor 705 may bypass gray level conversion, and, if an input image signal is an HDR image signal, the HDR processor 705 may perform gray level conversion. Consequently, it is possible to improve low gray level expression on the organic light emitting diode panel.

Meanwhile, the HDR processor 705 may perform gray level conversion processing based on a first gray level conversion mode, in which low gray level is to be enhanced and high gray level is to be saturated, and a second gray level conversion mode, in which low gray level and high gray level are somewhat uniformly converted.

The HDR processor 705 may perform gray level conversion processing based on a first gray level conversion curve or a second gray level conversion curve.

For example, the HDR processor 705 may perform gray level conversion processing based on data in a lookup table corresponding to the first gray level conversion curve or based on data in a lookup table corresponding to the second gray level conversion curve.

Specifically, if the first gray level conversion mode is implemented, the HDR processor 705 may perform gray level conversion processing based on data corresponding to the first gray level conversion mode in a lookup table.

More specifically, if the first gray level conversion mode is implemented, the HDR processor 705 may perform gray level conversion processing based on an equation of input data and the first gray level conversion mode in a lookup table determined by the equation. Here, the input data may include video data and metadata.

Meanwhile, if the second gray level conversion mode is implemented, the HDR processor 705 may perform gray level conversion processing based on data corresponding to the second gray level conversion mode in a lookup table.

More specifically, if the second gray level conversion mode is implemented, the HDR processor 705 may perform gray level conversion processing based on an equation of input data and data corresponding to the second gray level conversion mode in a lookup table determined by the equation. Here, the input data may include video data and metadata.

Meanwhile, the HDR processor 705 may select the first gray level conversion mode or the second gray level conversion mode according to a third gray level conversion mode or a fourth gray level conversion mode in a high gray level amplifying unit 851 in the second reduction unit 790.

For example, if the third gray level conversion mode is implemented, the high gray level amplifying unit 851 in the second reduction unit 790 may perform gray level conversion processing based o data corresponding to the third gray level conversion mode in a lookup table.

Specifically, if the third gray level conversion mode is implemented, the high gray level amplifying unit 851 in the second reduction unit 790 may perform gray level conversion processing based on an equation of input data and data corresponding to the third gray level conversion mode in a lookup table determined by the equation. Here, the input data may include video data and metadata.

Meanwhile, if the fourth type gray level conversion is implemented, the high gray level amplifying unit 851 in the second reduction unit 790 may perform gray level conversion processing based on data corresponding to the fourth gray level conversion mode in a lookup table.

Specifically, if the fourth gray level conversion mode is implemented, the high gray level amplifying unit 851 in the second reduction unit 790 may perform gray level conversion processing based on an equation of input data and data corresponding to the fourth gray level conversion mode in a lookup table determined by the equation. Here, the input data may include video data and metadata.

For example, if the fourth gray level conversion mode is implemented in the high gray level amplifying unit 851 in the second reduction unit 790, the HDR processor 705 may implement the second gray level conversion mode.

For another example, if the third gray level conversion mode is implemented in the high gray level amplifying unit 851 in the second reduction unit 790, the HDR processor 705 may implement the first gray level conversion mode.

Alternatively, the high gray level amplifying unit 851 in the second reduction unit 790 may change a gray level conversion mode according to a gray level conversion mode in the HDR processor 705.

For example, if the second gray level conversion mode is implemented in the HDR processor 705, the high gray level amplifying unit 851 in the second reduction unit 790 may perform the fourth gray level conversion mode.

For another example, if the first gray level conversion mode is implemented in the HDR processor 705, the high gray level amplifying unit 851 in the second reduction unit 790 may implement the third gray level conversion mode.

Meanwhile, the HDR processor 705 according to an embodiment of the present disclosure may implement a gray level conversion mode so that low gray level and high gray level are converted uniformly.

That is, the HDR processor 705 may perform gray level conversion processing based on the second gray level conversion curve, not the first gray level conversion curve.

Meanwhile, according to the second gray level conversion mode in the HDR processor 705, the second reduction unit 790 may implement the fourth gray level conversion mode and thereby amplify an upper limit on gray level of a received input signal. Consequently, it is possible to improve low gray level expression on the organic light emitting diode panel.

Next, the first reduction unit 710 may perform noise reduction on an input image signal or an image signal processed by the HDR processor 705.

Specifically, the first reduction unit 710 may perform multiple stages of noise reduction processing and a first stage of gray level extension processing on an input image signal or an HDR image from the HDR processor 705.

To this end, the first reduction unit 710 may include a plurality of noise reduction parts 715 and 720 for reducing noise in multiple stages, and a first gray level extension unit 725 for extending gray level.

Next, the enhancement unit 750 may perform multiple stages of image resolution enhancement processing on an image from the first reduction unit 710.

In addition, the enhancement unit 750 may perform object three-dimensional effect enhancement processing. In addition, the enhancement unit 750 may perform color or contrast enhancement processing.

To this end, the enhancement unit 750 may include: a plurality of resolution enhancement units 735, 738, 742 for enhancing a resolution of an image in multiple stages; an object three-dimensional effect enhancement unit 745 for enhancing a three-dimensional effect of an object; and a color contrast enhancement unit 749 for enhancing color or contrast.

Next, the second reduction unit 790 may perform a second stage of gray level extension processing based on a noise-reduced image signal received from the first reduction unit 710.

Meanwhile, the second reduction unit 790 may amplify an upper limit on gray level of an input signal, and extend a resolution of high gray level of the input signal. Consequently, it is possible to improve low gray level expression on the organic light emitting diode panel.

For example, gray level extension may be performed uniformly on the entire gray level range of an input signal. Accordingly, gray level extension is performed uniformly on the entire area of an input image, thereby improving high gray level expression.

Meanwhile, the second reduction unit 790 may perform gray level amplification and extension based on a signal received from the first gray level extension unit 725. Consequently, it is possible to improve low gray level expression on the organic light emitting diode panel.

Meanwhile, if an input image signal input is an SDR image signal, the second reduction unit 790 may vary the degree of amplification based on a user input signal. Accordingly, it is possible to improve high gray level expression in response to a user setting.

Meanwhile, if an input image signal is an HDR image signal, the second reduction unit 790 may perform amplification according to a set value. Consequently, it is possible to improve low gray level expression on the organic light emitting diode panel.

Meanwhile, if an input image signal is an HDR image signal, the second reduction unit 790 may vary the degree of amplification based on a user input signal. Accordingly, it is possible to improve high gray level expression according to a user setting.

Meanwhile, in the case of extending gray level based on a user input signal, the second reduction unit 790 may vary the degree of extension of gray level. Accordingly, it is possible to improve high gray level expression according to a user's setting.

Meanwhile, the second reduction unit 790 may amplify an upper limit on gray level according to a gray level conversion mode in the HDR processor 705. Consequently, it is possible to improve low gray level expression on the organic light emitting diode panel.

The signal processing device 170 includes the HDR processor 705 configured to receive an image signal and adjust luminance of the input image signal, and the reduction unit 790 configured to amplify brightness of the image signal received from the HDR processor 705 and increase gray level resolution of the image signal to thereby generate an enhanced image signal. The enhanced image signal provides increased luminance and increased gray level resolution of the image signal while a high dynamic range in a displayed HDR image is maintained.

Meanwhile, the range of brightness of the image signal is adjusted by a control signal received by the signal processing device 170.

Meanwhile, the signal processing device 170 further includes an image analyzer configured to determine whether an input image signal is an HDR signal or an SDR signal, and generate a control signal to be provided to the HDR processor 705. The range of brightness of an input image signal is adjusted by a control signal only when the input image signal is an HDR signal.

Meanwhile, the control signal is received from a controller of an image display apparatus, which relates to signal processing, and the control signal corresponds to a setting of the image display apparatus.

Meanwhile, a resolution of gray level is increased based on amplification of adjusted brightness of an image signal.

Meanwhile, a resolution of gray level is increased based on a control signal received by the signal processing device 170.

Meanwhile, a control signal is received from a controller of an image display apparatus, which relates to signal processing, and the control signal corresponds to a setting of the image display apparatus.

Meanwhile, the reduction unit 790 may include the high gray level amplifying unit 851 configured to amplify an upper limit on gray level of an input signal, and a decontouring unit 842 and 844 configured to extend the resolution of gray level amplified by the high gray level amplifying unit 851.

The second reduction unit 790 may include a second gray level extension unit 729 for a second stage of gray level extension.

Meanwhile, the image quality processor 635 in the signal processing device 170 according to the present disclosure is characterized in performing four stages of reduction processing and four stages of image enhancement processing, as shown in FIG. 8.

Here, the four stages of reduction processing may include two stages of noise reduction processing and two stages of gray level extension processing.

Herein, the two stages of noise reduction processing may be performed by the first and second noise reduction parts 715 and 720 in the first reduction unit 710, and the two stages of gray level extension processing may be performed by the first gray level extension unit 725 in the first reduction unit 710 and the second gray level extension unit 729 in the second reduction unit 790.

Meanwhile, the four stages of image enhancement processing may include three stages of image resolution enhancement (bit resolution enhancement) and object three-dimensional effect enhancement.

Here, the three stages of image enhancement processing may be performed by the first to third resolution enhancement units 735, 738, and 742, and the object three-dimensional effect enhancement may be performed by the object three-dimensional enhancement unit 745.

Meanwhile, the first characteristic of the signal processing device 170 of the present disclosure lies in applying the same algorithm or similar algorithms to image quality processing multiple times, thereby gradually enhancing an image quality.

To this end, the image quality processor 635 of the signal processing device 170 of the present disclosure may perform image quality processing by applying the same algorithm or similar algorithms two or more times.

Meanwhile, the same algorithm or the similar algorithms implemented by the image quality processor 635 have a different purpose to achieve in each stage. In addition, since image quality processing is performed gradually in multiple stages, there is an advantageous effect to cause a less number of artifacts to appear in an image, resulting in a more natural and more vivid image processing result.

Meanwhile, the same algorithm or the similar algorithms are applied multiple times alternately with a different image quality algorithm, thereby bringing an effect more than simple continuous processing.

Meanwhile, another characteristic of the signal processing device 170 of the present disclosure lies in performing noise reduction processing in multiple stages. Each stage of noise reduction processing may include temporal processing and spatial processing.

Meanwhile, the high dynamic range (HDR) technique utilizes a much greater range of luminosity (nit) than is possible a standard dynamic range (SDR) or any other existing technique, and accordingly a much wide range of contrast may be expressed.

Figure 8A:
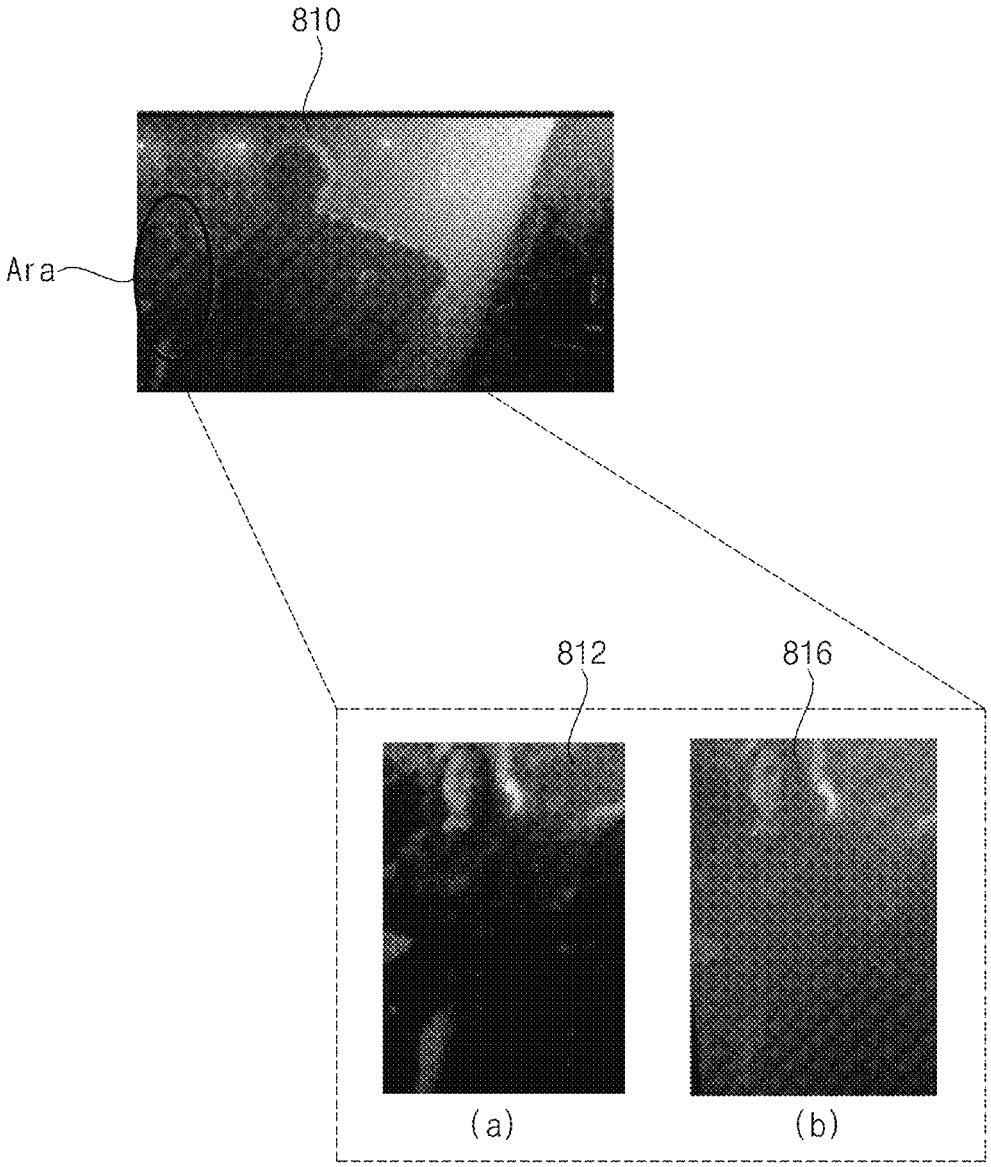
FIGS. 8A to 8C are diagrams referred to in the description of low gray level expression.
Figure 8B:
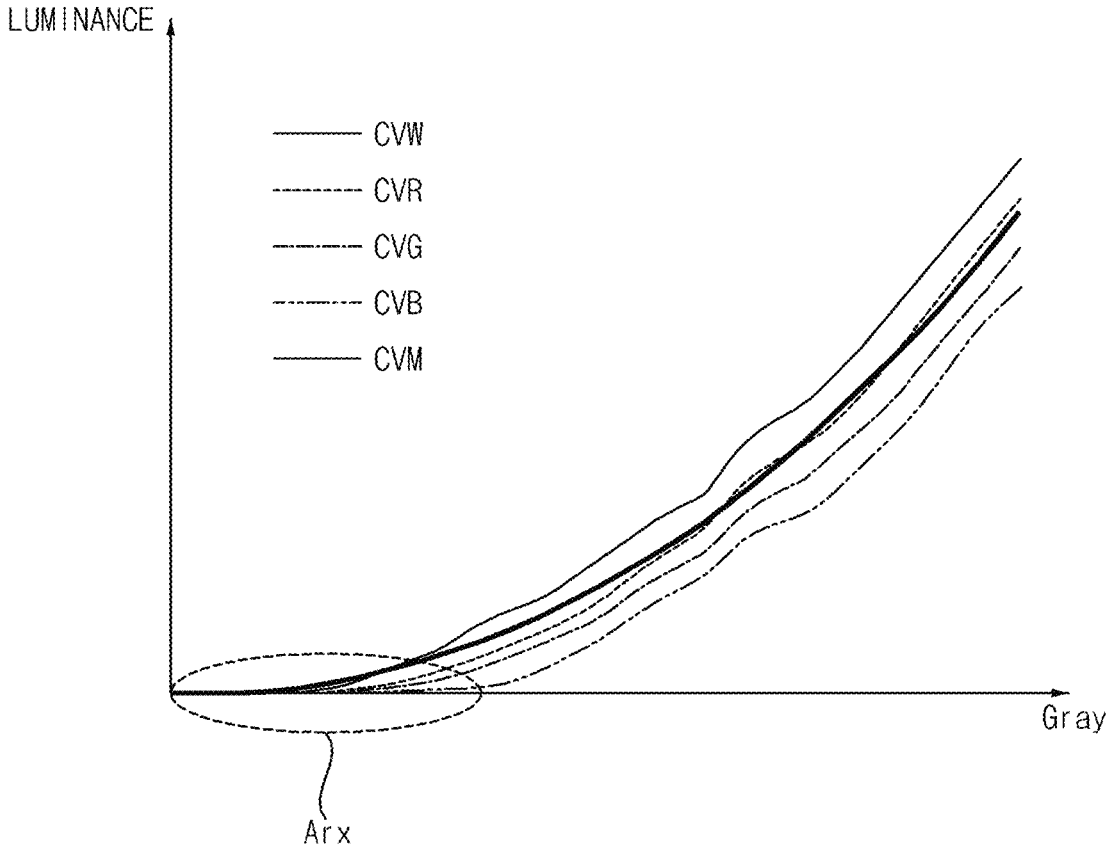
Figure 8C:
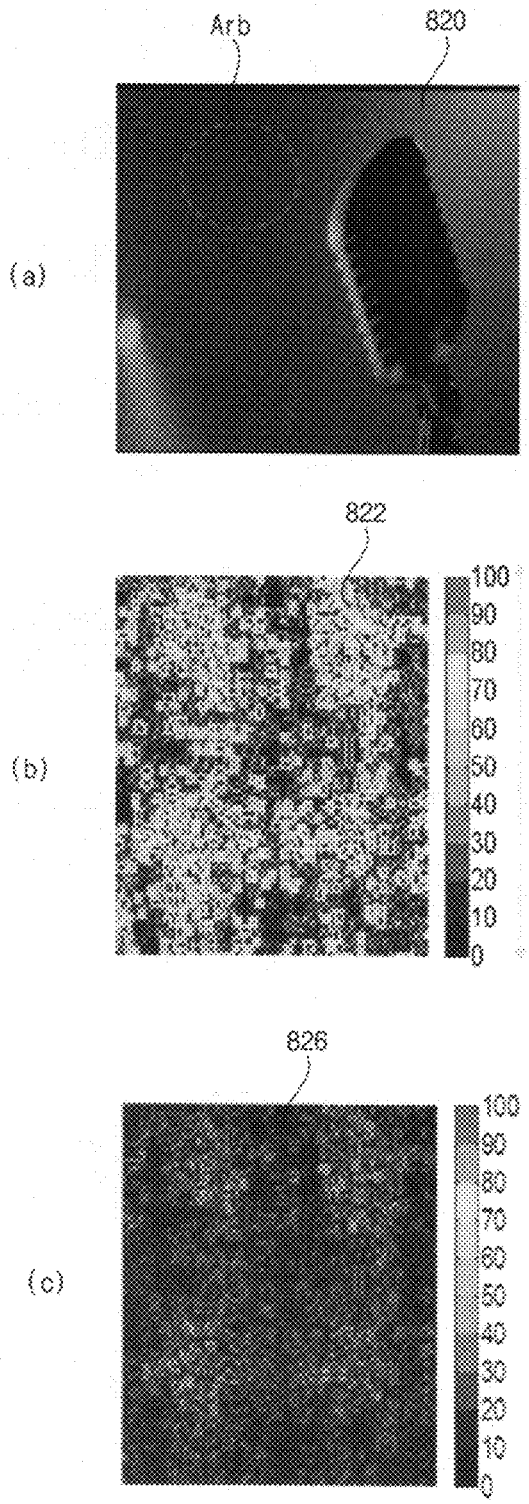

FIGS. 8A to 8C are diagrams referred to in the description of low gray level expression.

First, FIG. 8A illustrates an image 812 displayed on an organic light emitting diode panel and an image 816 displayed on a liquid crystal panel, each of which is an input image 810 including a dark low gray level area Ara.

The image 812 displayed on the organic light emitting diode panel 210 and the image 816 displayed on the liquid crystal panel are different from each other. In particular, it can be seen that the image 812 displayed on the organic light emitting diode panel 210 has higher contrast but the dark low gray level area Ara is not visually distinguishable.

FIG. 8B illustrates a gray-to-luminance conversion curve of an organic light emitting diode panel 210 including RGBW pixels.

Referring to the figure, it can be seen that luminance at the time of luminance conversion approximates to nearly 0 at an area Arx corresponding to a low gray level.

That is, referring to FIG. 8B, a value near black on the organic light emitting diode panel 210 approximates a luminance level of 0, whereby visual expression is not satisfactory.

FIG. 8C is a diagram referred to in the description of a luminance difference between adjacent pixels of the organic light emitting diode panel and the liquid crystal panel.

Referring to the figure, FIG. 8C(a) illustrates an input image 820 including a dark low gray level area Arb.

FIG. 8C(b) illustrates an image 822 including an enlarged low gray level area at the time of displaying the input image 820 on the organic light emitting diode panel 210.

FIG. 8C(c) illustrates an image 826 including an enlarged low gray level area at the time of displaying the input image 820 on the liquid crystal panel.

When comparing FIG. 8C(b) and FIG. 8C(c), it can be seen that, in the case of the organic light emitting diode panel 210, a luminance difference rate with respect to a neighboring pixel is higher than in the case of the liquid crystal panel.

For example, in the case in which the minimum luminance level of the organic light emitting diode panel 210 is 0.003 and the luminance level of an adjacent pixel is 0.004, a luminance difference rate with respect to the adjacent pixel is about 75%.

Meanwhile, in the case in which the minimum luminance level of the liquid crystal panel is 0.03 and the luminance level of an adjacent pixel is 0.036, a luminance difference rate with respect to the adjacent pixel is about 17%.

Since the minimum luminance level of the organic light emitting diode panel 210 is less than the minimum luminance level of the liquid crystal panel, the luminance difference rate with respect to the adjacent pixel increases.

As shown in FIG. 8C(b), therefore, a noise component in the low gray level area is more prominent than in the case of the liquid crystal panel of FIG. 8C(c).

Therefore, the present disclosure proposes a scheme for improving low gray level expression in a low gray level area of an input image having a low luminance level in consideration of visual characteristics thereof. In addition, the present disclosure provides a scheme for reducing noise in the low gray level area. This will be described hereinafter with reference to FIG. 9.

Figure 9:
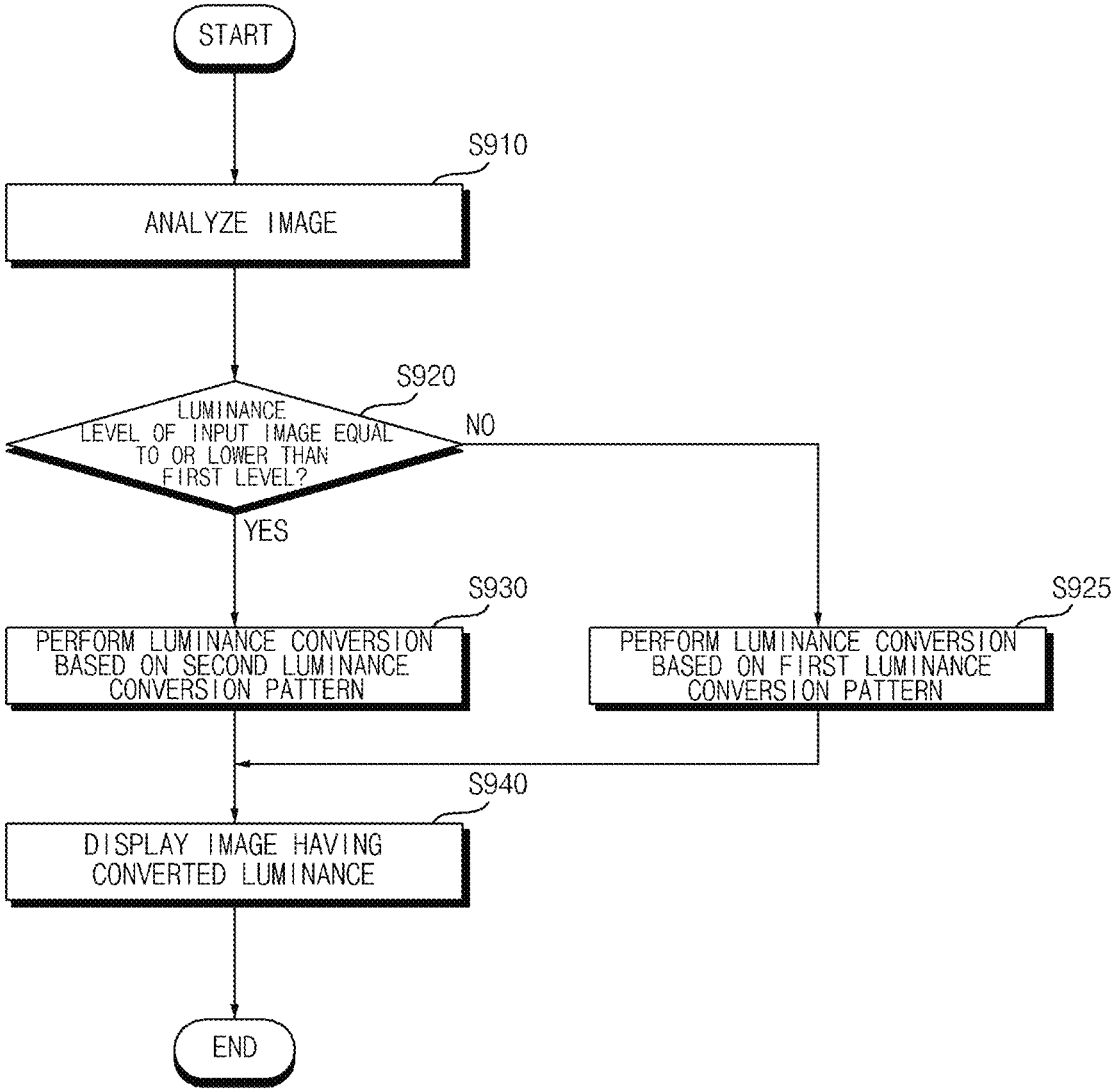
FIG. 9 is a flowchart showing a method of operating a signal processing device according to an embodiment of the present disclosure.

FIG. 9 is a flowchart showing a method of operating a signal processing device according to an embodiment of the present disclosure.

Referring to the figure, an image analyzer 610 in a signal processing device 170 according to an embodiment of the present disclosure analyzes an image (S910).

For example, the image analyzer 610 may analyze the average picture level (APL), noise, and resolution of an input image.

In addition, the image analyzer 610 may analyze the luminance of each area or each pixel of the input image.

Subsequently, a luminance converter 1020 in the signal processing device 170 determines whether the luminance level of a certain area of the input image is equal to or less than a first level (S920).

In the case in which the luminance level of the certain area of the input image is higher than the first level, the luminance converter 1020 in the signal processing device 170 performs luminance conversion based on a first luminance conversion pattern (S925).

Subsequently, in the case in which the luminance level of the certain area of the input image is equal to or less than the first level, the luminance converter 1020 in the signal processing device 170 performs luminance conversion based on a second luminance conversion pattern, which is higher than the first luminance conversion pattern (S930).

Meanwhile, in the case in which the average picture level (APL) of the input image is equal to or less than the second level and the luminance level of the certain area of the input image is equal to or less than the first level, the luminance converter 1020 may perform luminance conversion based on the second luminance conversion pattern, which is higher than the first luminance conversion pattern.

In the case in which the maximum value of the average picture level (APL) is 1024, the second level may be about 60. That is, in the state in which the input image is generally dark, luminance conversion may be performed with respect to a low gray level area in the image in order to improve luminance expression.

Specifically, in the state in which a dark image is input, luminance conversion may be performed with respect to a low gray level area in the image in order to improve the luminance thereof, thereby improving luminance expression of the low gray level area.

Subsequently, the signal processing device 170 performs control such that an image having converted luminance is output and displayed on a display 180 (S940).

Consequently, it is possible to display an image having a compensated low gray level area, particularly an image having improved luminance expression of a low gray level area, on the display 180 including the organic light emitting diode panel 210. Consequently, it is easy to visually distinguish between dark portions in the input image.

Figure 10:
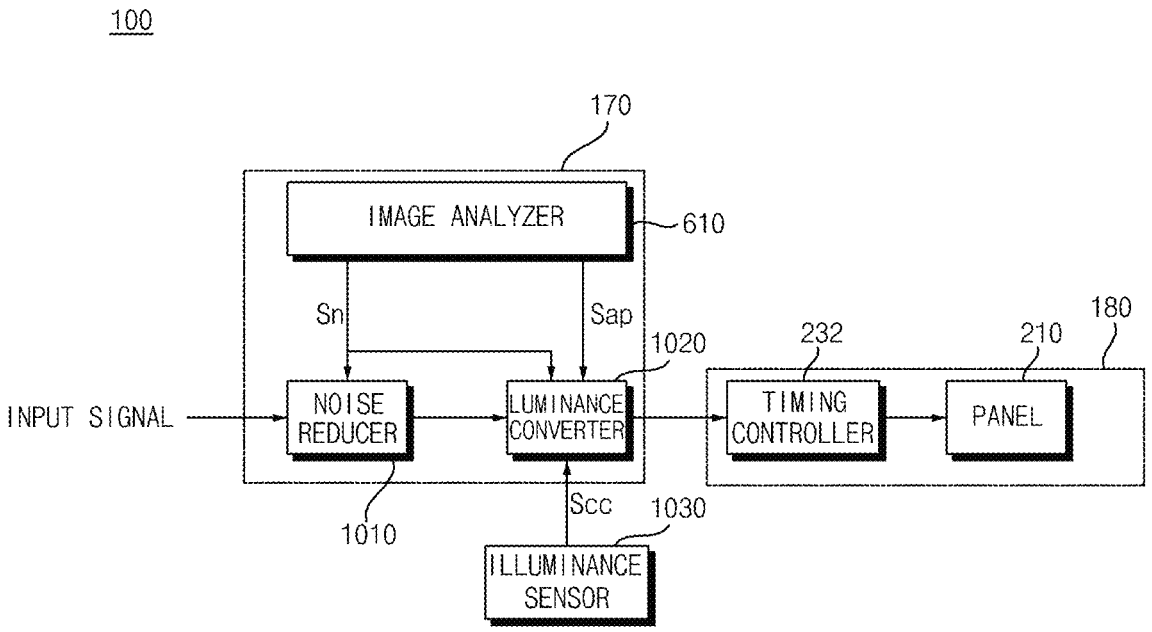
FIG. 10 is an example of an internal block diagram of an image display apparatus according to an embodiment of the present disclosure.

FIG. 10 is an example of an internal block diagram of an image display apparatus according to an embodiment of the present disclosure, and FIGS. 11A to 15C are diagrams referred to in the description of operation of the image display apparatus of FIG. 10.

Referring to the figure, the image display apparatus 100 may include a signal processor 170, an illuminance sensor 1030, and a display 180 including a timing controller 232 and an organic light emitting diode panel 210.

The illuminance sensor 1030 may sense illuminance around the display 180. In some implementations, the illuminance sensor 1030 may correspond to one or more hardware processors.

The signal processor 170 may include an image analyzer 610, a noise reducer 1010, and a luminance converter 1020.

The image analyzer 610 may analyze the average picture level (APL), noise, and resolution of an input image. In some implementations, the image analyzer 610 may correspond to one or more processors. In other implementations, the image analyzer 610 may correspond to software components configured to be executed by one or more processors.

In addition, the image analyzer 610 may analyze the luminance of each area or each pixel of the input image.

Meanwhile, the image analyzer 610 may output noise information Sn and luminance information Sap.

The noise reducer 1010 may perform noise reduction based on the noise information Sn from the image analyzer 610. In particular, the noise reducer 1010 may perform multistage noise reduction described with reference to FIG. 7. In some implementations, the noise reducer 1010 may correspond to one or more processors. In other implementations, the noise reducer 1010 may correspond to software components configured to be executed by one or more processors.

As a result, the noise reducer 1010 may reduce noise of the input image. In particular, the noise reducer 1010 may reduce noise of a low gray level area of the input image. At this time, the low gray level area may correspond to an area having a luminance level less than a first level.

The luminance converter 1020 may perform luminance conversion based on the luminance information Sap from the image analyzer 610. In some implementations, the luminance converter 1020 may correspond to one or more processors. In other implementations, the luminance converter 1020 may correspond to software components configured to be executed by one or more processors.

Figure 11A:
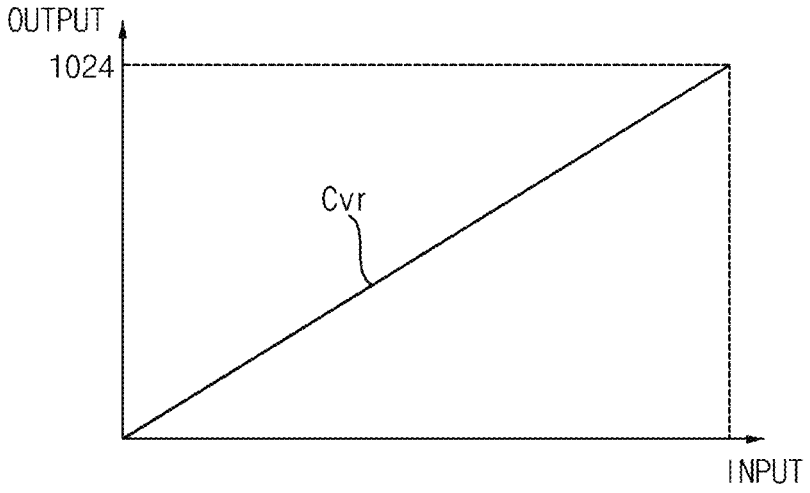
FIGS. 11A to 15C are diagrams referred to in the description of operation of the image display apparatus of FIG. 10.

FIG. 11A illustrates a luminance conversion curve CVr for input luminance to output luminance conversion of an input image.

Referring to FIG. 11A, input luminance to output luminance conversion is performed at a uniform rate. However, in this case, particularly in the case of the organic light emitting diode panel 210, visual characteristics of a low gray level area are not excellent, as described with reference to FIGS. 8A to 8C.

Figure 11B:
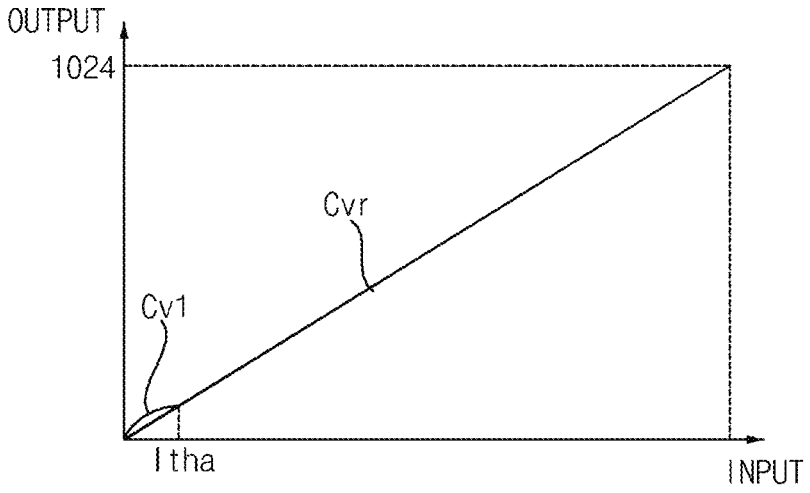

FIG. 11B illustrates an example of luminance conversion according to an embodiment of the present disclosure.

Referring to the figure, a luminance converter 1020 according to an embodiment of the present disclosure may perform luminance conversion based on a first luminance conversion pattern CVr in the case in which the luminance level of an input image is greater a first level ltha, and may perform luminance conversion based on a second luminance conversion pattern CV1, which has a higher luminance level than the first luminance conversion pattern CVr, in the case in which the luminance level of the input image is equal to or less than the first level ltha.

Meanwhile, as shown in the figure, the luminance converter 1020 may perform control such that a change rate of the second luminance conversion pattern CV1 is greater than a change rate of the first luminance conversion pattern CVr.

Meanwhile, as shown in the figure, in the case in which the luminance level of the input image is equal to or less than the first level ltha, the luminance converter 1020 may perform conversion to a luminance level higher than the luminance level of the input image.

Consequently, it is possible to improve low gray level expression of the organic light emitting diode panel 210. As a result, it is easy to visually distinguish between dark portions in the input image.

In particular, it is possible to improve luminance expression of an area of the input area having a luminance level equal to or less than the first level ltha.

Meanwhile, in the case in which the average picture level (APL) of the input image is equal to or less than the second level and the luminance level of a certain area of the input image is equal to or less than the first level, the luminance converter 1020 may perform luminance conversion based on the second luminance conversion pattern, which is higher than the first luminance conversion pattern.

In the case in which the maximum value of the average picture level (APL) is 1024, the second level may be about 60. That is, in the state in which the input image is generally dark, luminance conversion may be performed with respect to a low gray level area in the image in order to improve luminance expression.

Specifically, in the state in which a dark image is input, luminance conversion may be performed with respect to a low gray level area in the image in order to improve the luminance thereof, thereby improving luminance expression of the low gray level area.

Meanwhile, the luminance converter 1020 may change the first level ltha based on illuminance sensed by the illuminance sensor 1030. Consequently, it is possible to improve low gray level expression of the organic light emitting diode panel 210 based on ambient illuminance.

Figure 11C:
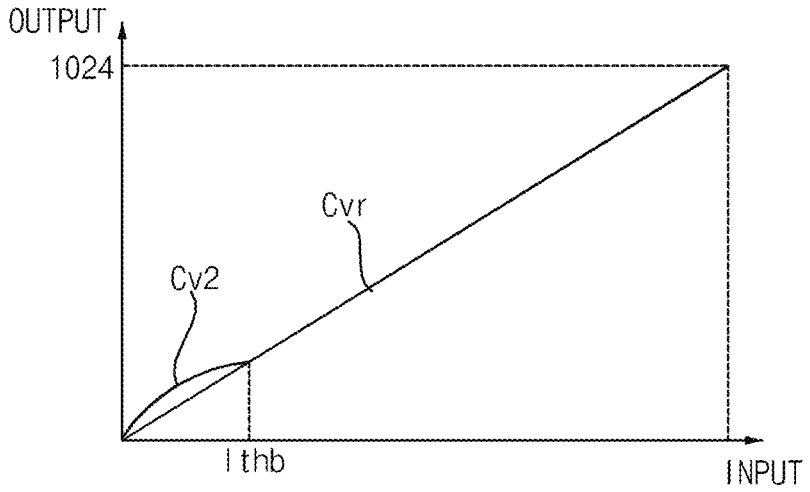

FIG. 11C illustrates another example of luminance conversion according to an embodiment of the present disclosure.

Referring to the figure, the luminance converter 1020 may perform luminance conversion based on a first luminance conversion pattern CVr in the case in which the luminance level of an input image is greater lthb, and may perform luminance conversion based on a third luminance conversion pattern CV2, which has a higher luminance level than the first luminance conversion pattern CVr, in the case in which the luminance level of the input image is equal to or less than lthb. Consequently, it is possible to improve low gray level expression of the organic light emitting diode panel 210. As a result, it is easy to visually distinguish between dark portions in the input image.

When comparing FIG. 11B and FIG. 11C, lthb is higher than ltha of FIG. 11B.

Meanwhile, it is assumed that the illuminance of FIG. 11B is first illuminance and the illuminance of FIG. 11C is second illuminance, which is higher than the first illuminance.

The luminance converter 1020 may increase the first level ltha, as the illuminance level sensed by the illuminance sensor 1030 increases. Consequently, it is possible to improve expression of a wider low gray level on the organic light emitting diode panel 210 as ambient illuminance becomes brighter.

That is, FIG. 11C illustrates that the first level ltha increases to lthb. Consequently, it is possible to improve low gray level expression of the organic light emitting diode panel 210 based on ambient illuminance. As a result, it is easy to visually distinguish between dark portions in the input image.

Figure 12:
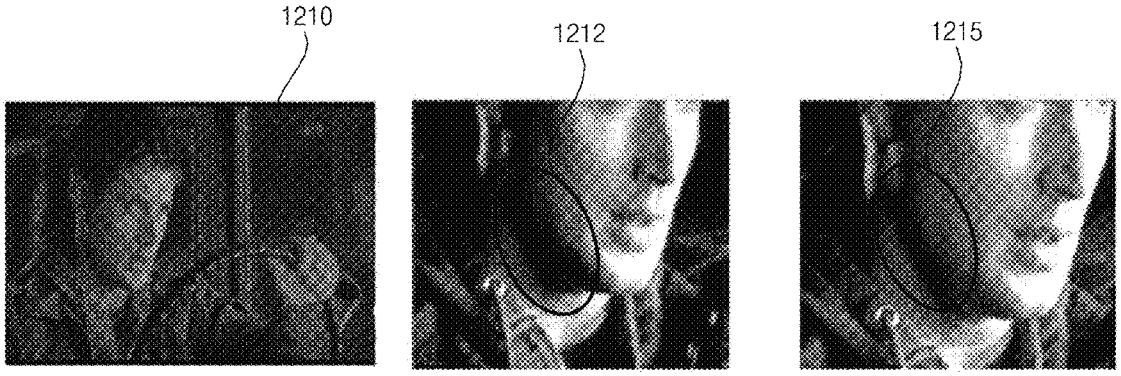

FIG. 12(*a*) illustrates an input image 1210, FIG. 12(*b*) illustrates an image displayed as the result of luminance conversion according to FIGS. 11A, and 12(*c*) illustrates an image displayed as the result of luminance conversion according to FIG. 11B.

In connection with a low gray level area in the input image 1210, it can be seen that an area 1212 of FIG. 12(*b*) corresponding thereto is dark and thus is difficult to visually distinguish but low gray level expression of an area 1215 of FIG. 12(*c*) corresponding thereto is improved through luminance conversion of FIG. 11B or FIG. 11C.

Figure 13:
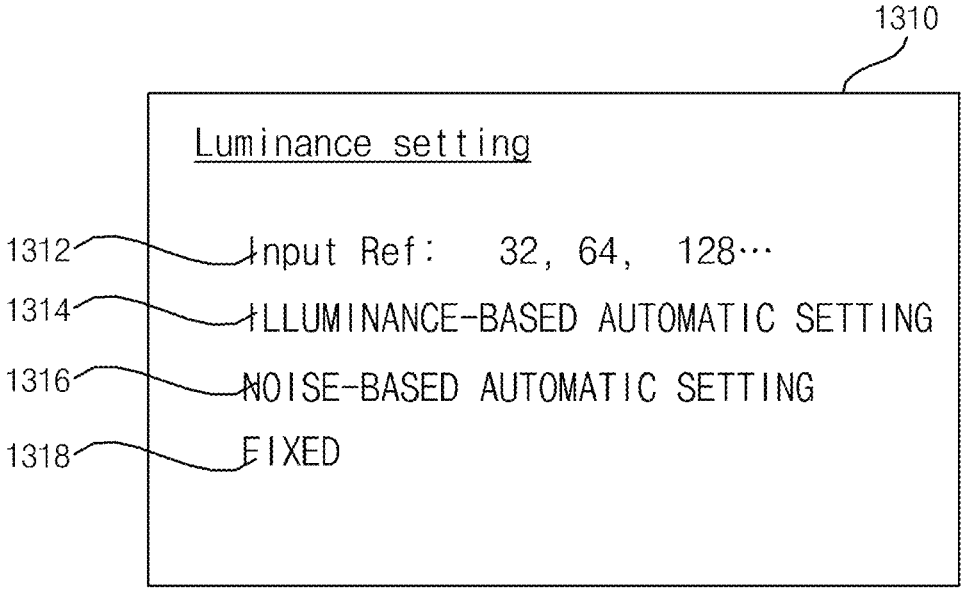

FIG. 13 illustrates a luminance setting screen 1310 configured to improve low gray level expression.

Referring to the figure, the luminance converter 1020 may provide a luminance setting screen 1310 including a manual setting item 1312 for level setting of the first level ltha, automatic setting items 1314 and 1316 for automatic setting of the first level ltha, and a fixed item 1318 for fixed setting of the first level ltha.

Consequently, it is possible to display an image based on various settings. As a result, it is possible to improve low gray level expression.

Meanwhile, various modifications are possible although concrete levels 32, 64, 128, and the like are illustrated in the manual setting item 1312 in the figure.

Meanwhile, the automatic setting items 1314 and 1316 may include an illuminance-based automatic setting item 1314 for automatic setting of the first level ltha based on ambient illuminance and a noise-based automatic setting item 1316 for automatic setting of the first level ltha based on noise of the input image. Consequently, it is possible to automatically improve low gray level expression.

Meanwhile, the noise reducer 1010 may perform noise reduction with respect to the input image based on input noise information Sn.

Figure 14:
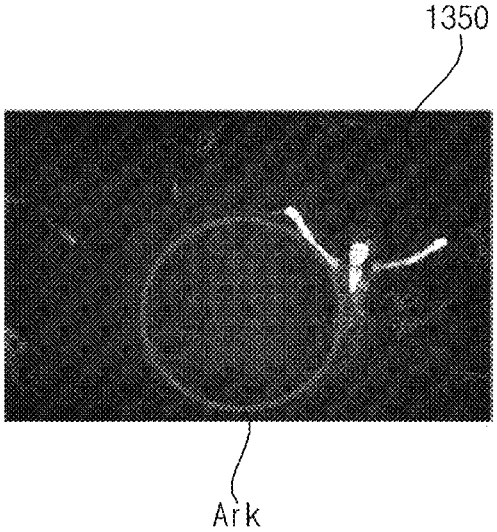
Figure 14:
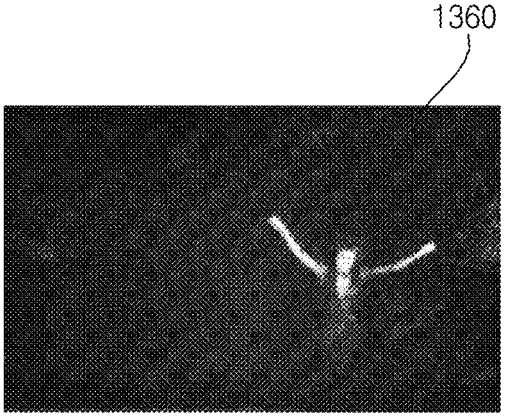

FIG. 14(*a*) illustrates that an image 1350 before noise reduction includes a noise component Ark.

FIG. 14(*b*) illustrates that an image 1360 after noise reduction includes an area having reduced noise. Consequently, it is possible to reduce noise of the input image.

Figure 15A:
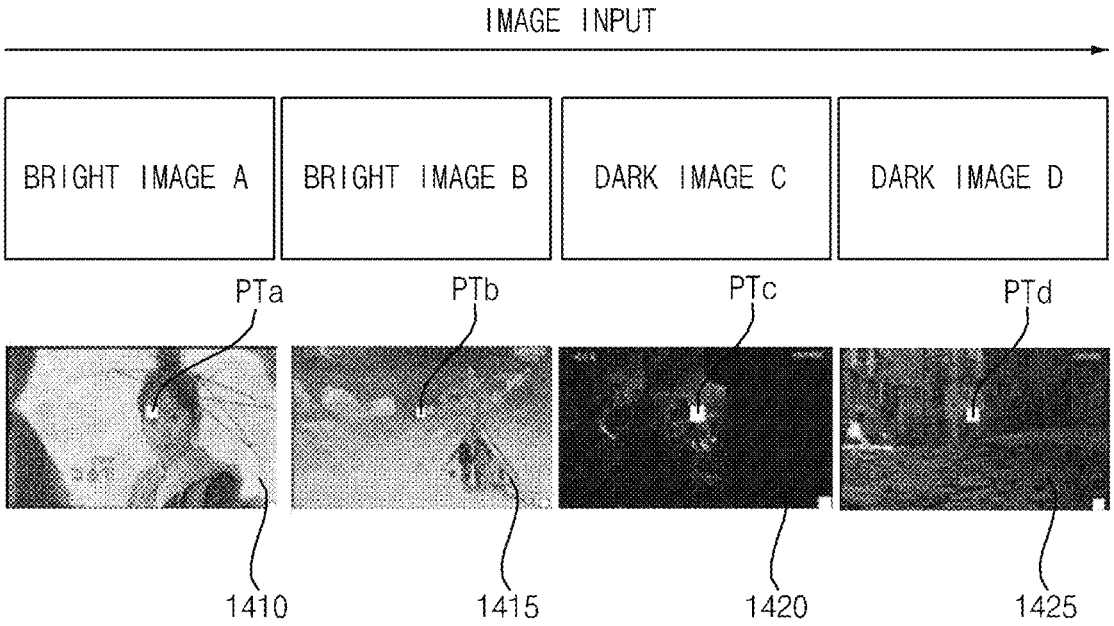
Figure 15B:
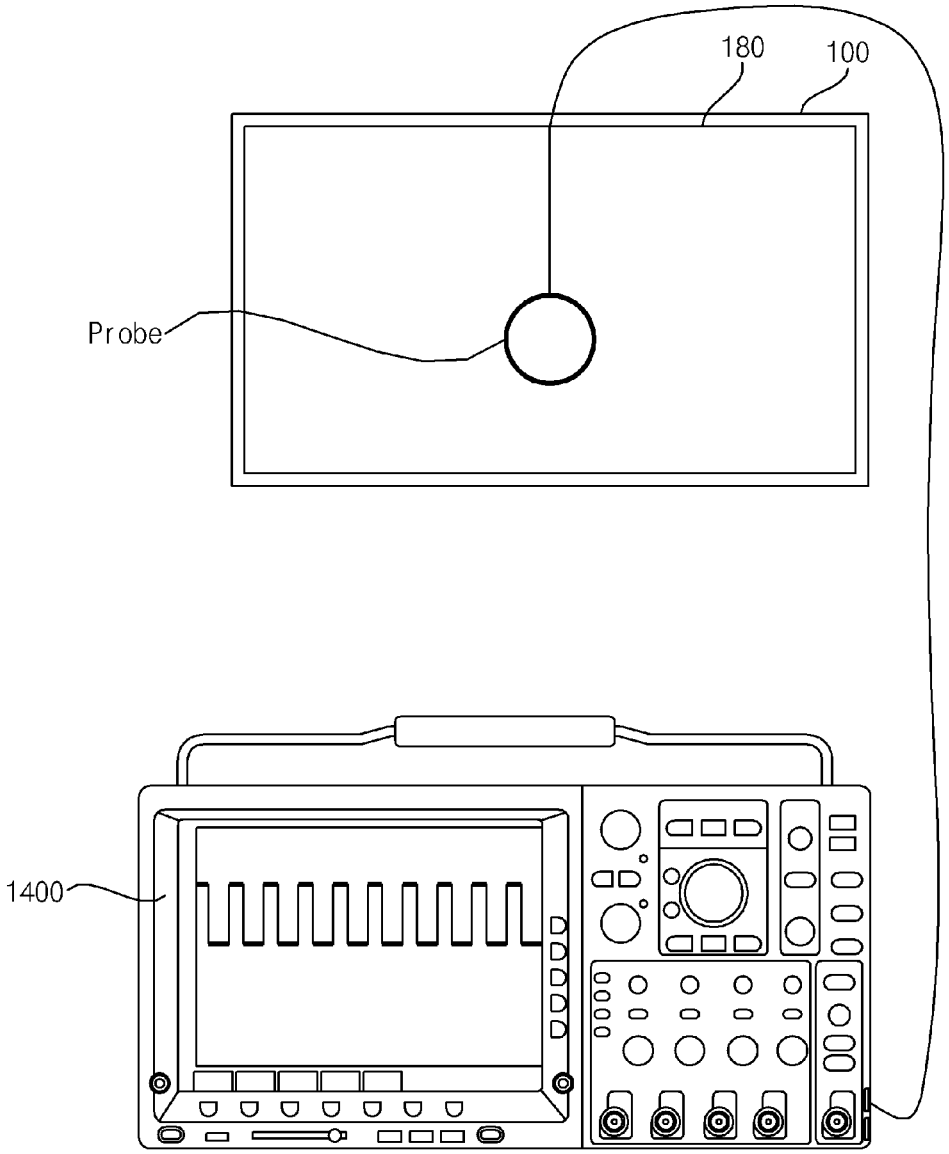
Figure 15C:
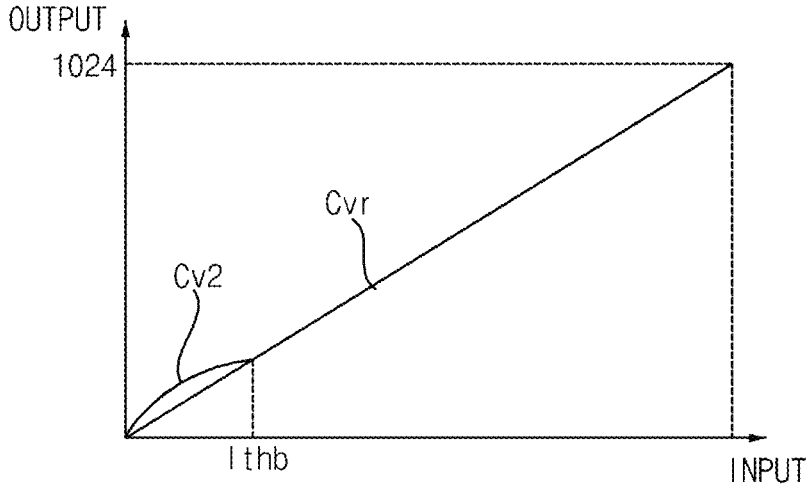

FIGS. 15A to 15C, which are related to another embodiment of the present disclosure, are diagrams illustrating that a pattern is added to an input image and luminance conversion is measured through a change in luminance of the pattern.

FIG. 15A illustrates that a bright image 1410, a bright image 1415, a dark image 1420, and a dark image 1425 are sequentially input.

As described above, each of the bright image 1410 and the bright image 1415 may have an average picture level higher than the second level, and each of the dark image 1420 and the dark image 1425 may have an average picture level equal to or less than the second level.

A signal processor 170 according to an embodiment of the present invention may insert predetermined patterns PTa to PTd into the input images 1410 to 1425, and may change the luminance level of each of the patterns PTa to PTd.

In addition, the luminance of each of the patterns PTa to PTd displayed on the display 180 including the organic light emitting diode panel 210 after luminance conversion may be measured using a probe of a luminance measurement instrument 1400 of FIG. 15B.

According to an embodiment of the present disclosure, as shown in FIG. 15C, the signal processor 170 may perform luminance conversion based on a first luminance conversion pattern CVr in the case in which the luminance level is greater a first level ltha, and may perform luminance conversion based on a second luminance conversion pattern CV1, which has a higher luminance level than the first luminance conversion pattern CVr, in the case in which the luminance level is equal to or less than the first level ltha.

As shown in FIG. 15C, therefore, the luminance of each of the patterns PTa to PTd measured by the luminance measurement instrument 1400 has the first luminance conversion pattern CVr in the case in which the luminance level is greater the first level ltha, and has the second luminance conversion pattern CV1, which has a higher luminance level than the first luminance conversion pattern CVr, in the case in which the luminance level is equal to or less than the first level ltha.

Meanwhile, according to an embodiment of the present invention, the first luminance conversion pattern CVr and the second luminance conversion pattern CV1 may be applied to all input images irrespective of the average picture level of each of the input images.

That is, these patterns may be applied to all of the bright image 1410, the bright image 1415, the dark image 1420, and the dark image 1425.

Meanwhile, according to another embodiment of the present invention, the first luminance conversion pattern CVr and the second luminance conversion pattern CV1 may be applied only in the case in which the average picture level of an input image is equal to or less than the second level.

That is, these patterns may be applied to only the dark image 1420 and the dark image 1425, among the bright image 1410, the bright image 1415, the dark image 1420, and the dark image 1425.

As shown in FIG. 15C, therefore, the luminance of each of the patterns PTc and PTd measured by the luminance measurement instrument 1400 has the first luminance conversion pattern CVr in the case in which the luminance level is greater the first level ltha, and has the second luminance conversion pattern CV1, which has a higher luminance level than the first luminance conversion pattern CVr, in the case in which the luminance level is equal to or less than the first level ltha.

As is apparent from the above description, an image display apparatus according to an embodiment of the present invention includes a display including an organic light emitting diode panel and a signal processor configured to control the display, wherein the signal processor is configured to perform luminance conversion based on a first luminance conversion pattern in the case in which the luminance level of an input image is greater a first level and to perform luminance conversion based on a second luminance conversion pattern having a higher luminance level than the first luminance conversion pattern in the case in which the luminance level of the input image is equal to or less than the first level. Consequently, it is possible to improve low gray level expression of an organic light emitting diode panel. As a result, it is easy to visually distinguish between dark portions in the input image.

Meanwhile, the signal processor may change the first level based on illuminance sensed by an illuminance sensor. Consequently, it is possible to improve low gray level expression of the organic light emitting diode panel based on ambient illuminance.

Meanwhile, the signal processor may increase the first level as an illuminance level sensed by the illuminance sensor increases. Consequently, it is possible to improve expression of a wider low gray level on the organic light emitting diode panel as ambient illuminance becomes brighter.

Meanwhile, a change rate of the second luminance conversion pattern may be greater than a change rate of the first luminance conversion pattern. Consequently, it is possible to improve low gray level expression of the organic light emitting diode panel.

Meanwhile, in the case in which the luminance level of the input image is equal to or less than the first level, the signal processor may perform conversion to a luminance level higher than the luminance level of the input image. Consequently, it is possible to improve low gray level expression in the case in which the luminance level of the organic light emitting diode panel is equal to or less than the first level.

Meanwhile, the signal processor may provide a luminance setting screen including a manual setting item for level setting of the first level, an automatic setting item for automatic setting of the first level, and a fixed item for fixed setting of the first level. Consequently, it is possible to display an image based on various settings. As a result, it is possible to improve low gray level expression.

Meanwhile, the automatic setting item may include an illuminance-based automatic setting item for automatic setting of the first level based on ambient illuminance and a noise-based automatic setting item for automatic setting of the first level based on noise of the input image. Consequently, it is possible to automatically improve low gray level expression.

Meanwhile, the signal processor may include an image analyzer configured to analyze luminance of the input image and a luminance converter configured to perform luminance conversion based on the luminance analyzed by the image analyzer, and the luminance converter may be configured to perform luminance conversion based on the first luminance conversion pattern in the case in which the luminance level of the input image is greater the first level and to perform luminance conversion based on the second luminance conversion pattern having a higher luminance level than the first luminance conversion pattern in the case in which the luminance level of the input image is equal to or less than the first level. Consequently, it is possible to improve low gray level expression in the case in which the luminance level of the organic light emitting diode panel is equal to or less than the first level.

Meanwhile, the signal processor may further include a noise reducer configured to perform noise reduction with respect to the input image, and the noise reducer may perform noise reduction in stages. Consequently, it is possible to reduce noise of the input image.

Meanwhile, the signal processor may be configured to insert a predetermined pattern into the input image and to change the luminance level of the pattern, to perform luminance conversion based on the first luminance conversion pattern in the case in which the luminance level of the pattern is greater the first level, and to perform luminance conversion based on the second luminance conversion pattern in the case in which the luminance level of the pattern is equal to or less than the first level. Consequently, it is possible to improve low gray level expression in the case in which the luminance level of the organic light emitting diode panel is equal to or less than the first level.

Meanwhile, the signal processor may be configured to insert a predetermined pattern into the input image and to change the luminance level of the pattern, to perform uniform-rate luminance conversion in the case in which the luminance level of the pattern is greater the first level, and to perform luminance conversion for increasing luminance increment in the case in which the luminance level of the pattern is equal to or less than the first level. Consequently, it is possible to improve low gray level expression in the case in which the luminance level of the organic light emitting diode panel is equal to or less than the first level.

An image display apparatus according to another embodiment of the present disclosure includes a display including an organic light emitting diode panel and a signal processor configured to control the display, wherein the signal processor is configured to insert a predetermined pattern into an input image and to change the luminance level of the pattern, to perform luminance conversion based on a first luminance conversion pattern in the case in which the luminance level of the pattern is greater a first level, and to perform luminance conversion based on a second luminance conversion pattern having a higher luminance level than the first luminance conversion pattern in the case in which the luminance level of the pattern is equal to or less than the first level. Consequently, it is possible to improve low gray level expression of an organic light emitting diode panel. As a result, it is easy to visually distinguish between dark portions in the input image.

Meanwhile, the signal processor may be configured to perform uniform-rate luminance conversion in the case in which the luminance level of the pattern is greater the first level and to perform luminance conversion based on the second luminance conversion pattern having a nonuniform rate, in the case in which the luminance level of the pattern is equal to or less than the first level. Consequently, it is possible to improve low gray level expression in the case in which the luminance level of the organic light emitting diode panel is equal to or less than the first level.

A signal processing device according to an embodiment of the present disclosure includes an image analyzer configured to analyze luminance of an input image and a luminance converter configured to perform luminance conversion based on the luminance analyzed by the image analyzer, wherein the luminance converter is configured to perform luminance conversion based on a first luminance conversion pattern in the case in which the luminance level of the input image is greater a first level and to perform luminance conversion based on a second luminance conversion pattern having a higher luminance level than the first luminance conversion pattern in the case in which the luminance level of the input image is equal to or less than the first level. Consequently, it is possible to improve low gray level expression in the case in which the luminance level of the organic light emitting diode panel is equal to or less than the first level.

Meanwhile, a signal processing device according to an embodiment of the present disclosure may further include a noise reducer configured to perform noise reduction with respect to the input image, wherein the noise reducer may perform noise reduction in stages. Consequently, it is possible to reduce noise of the input image.

Meanwhile, the luminance converter may perform control such that the first level is changed based on illuminance around a display. Consequently, it is possible to improve low gray level expression of the organic light emitting diode panel based on ambient illuminance.

Meanwhile, the luminance converter may perform control such that a change rate of the second luminance conversion pattern is greater than a change rate of the first luminance conversion pattern. Consequently, it is possible to improve low gray level expression of the organic light emitting diode panel.

Meanwhile, the luminance converter may be configured to insert a predetermined pattern into the input image and to change a luminance level of the pattern, to perform luminance conversion based on the first luminance conversion pattern in the case in which the luminance level of the pattern is greater a first level, and to perform luminance conversion based on the second luminance conversion pattern in the case in which the luminance level of the pattern is equal to or less than the first level. Consequently, it is possible to improve low gray level expression in the case in which the luminance level of the organic light emitting diode panel is equal to or less than the first level.

Meanwhile, the luminance converter may be configured to perform uniform-rate luminance conversion in the case in which the luminance level of the pattern is greater the first level and to perform luminance conversion based on the second luminance conversion pattern having a nonuniform rate, in the case in which the luminance level of the pattern is equal to or less than the first level. Consequently, it is possible to improve low gray level expression in the case in which the luminance level of the organic light emitting diode panel is equal to or less than the first level.

While the present disclosure has been particularly shown and described with reference to exemplary embodiments thereof, it is clearly understood that the same is by way of illustration and example only and is not to be taken in conjunction with the present disclosure. It will be understood by those skilled in the art that various changes in form and details may be made therein without departing from the subject matter and scope of the present disclosure.

What is claimed is:

1. An image display apparatus comprising:

a display comprising an organic light emitting diode panel; and a signal processor configured to:

control the display, perform a luminance conversion according to a first luminance conversion pattern based at least in part on a luminance level of an input image being greater than a first level; and perform the luminance conversion according to a second luminance conversion pattern based at least in part on the luminance level of the input image being equal to or less than the first level, wherein the second luminance conversion pattern has a higher luminance level than the first luminance conversion pattern, wherein the signal processor is further configured to:

insert a predetermined pattern into a second input image;

change a luminance level of the inserted predetermined pattern;

perform the luminance conversion according to the first luminance conversion pattern based at least in part on the changed luminance level of the inserted predetermined pattern being greater the first level; and perform the luminance conversion according to the second luminance conversion pattern based at least in part on the changed luminance level of the inserted predetermined pattern being equal to or less than the first level.

2. The image display apparatus of claim 1, further comprising an illuminance sensor configured to sense illuminance around the display, wherein the signal processor is further configured to change the first level based at least in part on the sensed illuminance.

3. The image display apparatus of claim 2, wherein the signal processor is further configured to increase the first level as the sensed illuminance increases.

4. The image display apparatus of claim 1, wherein the second luminance conversion pattern has a greater change rate than the first luminance conversion pattern.

5. The image display apparatus of claim 1, wherein the signal processor is further configured to perform the luminance conversion to a luminance level higher than the luminance level of the input image based at least in part on the luminance level of the input image being equal to or less than the first level.

6. The image display apparatus of claim 1, wherein the signal processor is further configured to provide a luminance setting screen comprising a manual setting item for a manual setting of the first level, an automatic setting item for an automatic setting of the first level, or a fixed item for a fixed setting of the first level.

7. The image display apparatus of claim 6, wherein the automatic setting item comprises:

an illuminance-based automatic setting item for the automatic setting of the first level based on an ambient illuminance; and a noise-based automatic setting item for the automatic setting of the first level based on a noise of the input image.

8. The image display apparatus of claim 1, wherein the signal processor comprises an image analyzer configured to analyze luminance of the input image, and wherein the luminance conversion is performed based at least in part on the analyzed luminance of the input image.

9. The image display apparatus of claim 8, wherein the signal processor further comprises a noise reducer configured to perform noise reduction in stages with respect to the input image.

10. The image display apparatus of claim 1, wherein the signal processor is further configured to:

change a luminance level of the inserted predetermined pattern;

perform a uniform-rate luminance conversion based at least in part on the changed luminance level of the inserted predetermined pattern being greater than the first level; and perform the luminance conversion for increasing luminance increment based at least in part on the changed luminance level of the inserted predetermined pattern being equal to or less than the first level.

11. An image display apparatus comprising:

a display comprising an organic light emitting diode panel; and a signal processor configured to control the display, wherein the signal processor is further configured to:

insert a predetermined pattern into an input image;

change a luminance level of the inserted predetermined pattern;

perform a luminance conversion according to a first luminance conversion pattern based at least in part on the changed luminance level of the inserted predetermined pattern being greater than a first level; and perform the luminance conversion according to a second luminance conversion pattern based at least in part on the changed luminance level of the pattern being equal to or less than the first level, wherein the second luminance conversion pattern has a higher luminance level than the first luminance conversion pattern.

12. The image display apparatus of claim 11, wherein the signal processor is further configured:

to perform a uniform-rate luminance conversion based at least in part on the changed luminance level of the inserted predetermined pattern being greater the first level; and to perform the luminance conversion according to the second luminance conversion pattern based at least in part on the changed luminance level of the inserted predetermined pattern being equal to or less than the first level, wherein the second luminance conversion pattern has a nonuniform rate.

13. A signal processing device comprising:

an image analyzer configured to analyze luminance of an input image; and a luminance converter configured to:

perform luminance conversion based at least in part on the analyzed luminance of the input image, wherein the luminance converter is further configured to:

perform a luminance conversion according to a first luminance conversion pattern based at least in part on a luminance level of the input image being greater than a first level; and perform the luminance conversion according to a second luminance conversion pattern based at least in part on the luminance level of the input image being equal to or less than the first level, wherein the second luminance conversion pattern has a higher luminance level than the first luminance conversion pattern, wherein the luminance converter is further configured to:

insert a predetermined pattern into a second input image;

change a luminance level of the inserted predetermined pattern;

perform the luminance conversion according to the first luminance conversion pattern based at least in part on the changed luminance level of the inserted predetermined pattern being greater than a first level; and perform the luminance conversion according to the second luminance conversion pattern based at least in part on the changed luminance level of the inserted predetermined pattern being equal to or less than the first level.

14. The signal processing device of claim 13, further comprising a noise reducer configured to perform noise reduction in stages with respect to the input image.

15. The signal processing device of claim 13, wherein the luminance converter is further configured to change the first level based at least in part on a illuminance around a display.

16. The signal processing device of claim 13, wherein the second luminance conversion pattern has a greater change rate than the first luminance conversion pattern.

17. The signal processing device of claim 13, wherein the luminance converter is further configured to:

change a luminance level of the inserted predetermined pattern;

perform a uniform-rate luminance conversion based at least in part on the changed luminance level of the inserted predetermined pattern being greater the first level; and perform the luminance conversion according to the second luminance conversion pattern based at least in part on the luminance level of the inserted predetermined pattern being equal to or less than the first level, wherein the second luminance conversion pattern has a nonuniform rate.

* * * * *